US008512120B2

(12) United States Patent
Nelson et al.

(10) Patent No.: US 8,512,120 B2
(45) Date of Patent: Aug. 20, 2013

(54) GAMING SYSTEM, GAMING DEVICE, AND METHOD PROVIDING MULTIPLE SIMULTANEOUSLY PLAYABLE WAGERING GAMES WITH INDIVIDUAL CREDIT BALANCES

(75) Inventors: Dwayne R. Nelson, Las Vegas, NV (US); Andrew P. Kertesz, Henderson, NV (US)

(73) Assignee: IGT, Las Vegas, NV (US)

( * ) Notice: Subject to any disclaimer, the term of this patent is extended or adjusted under 35 U.S.C. 154(b) by 11 days.

(21) Appl. No.: 13/238,781

(22) Filed: Sep. 21, 2011

(65) Prior Publication Data

US 2013/0072289 A1 Mar. 21, 2013

(51) Int. Cl.
*G07F 17/32* (2006.01)

(52) U.S. Cl.
USPC ..... 463/16; 463/20; 463/25

(58) Field of Classification Search
USPC ..... 463/16–20, 25–29
See application file for complete search history.

(56) References Cited

U.S. PATENT DOCUMENTS

| | | | |
|---|---|---|---|
| 4,448,419 | A | 5/1984 | Telnaes |
| 4,467,424 | A | 8/1984 | Hedges et al. |
| 4,621,814 | A | 11/1986 | Stepan et al. |
| 4,679,143 | A | 7/1987 | Hagiwara |
| 4,695,053 | A | 9/1987 | Vazquez, Jr. et al. |
| 4,838,552 | A | 6/1989 | Hagiwara |
| 4,856,787 | A | 8/1989 | Itkis |
| 4,874,173 | A | 10/1989 | Kishishita |
| 4,926,327 | A | 5/1990 | Sidley |
| 4,991,848 | A | 2/1991 | Greenwood et al. |
| 5,116,055 | A | 5/1992 | Tracy |
| 5,152,529 | A | 10/1992 | Okada |
| 5,159,549 | A | 10/1992 | Hallman, Jr. et al. |
| 5,178,390 | A | 1/1993 | Okada |
| 5,179,517 | A | 1/1993 | Sarbin et al. |

(Continued)

FOREIGN PATENT DOCUMENTS

| | | |
|---|---|---|
| GB | 2 098 778 | 11/1982 |
| GB | 2 161 008 | 1/1986 |

(Continued)

OTHER PUBLICATIONS

International Search Report and Written Opinion of the International Searching Authority for corresponding PCT Application No. PCT/US2012/53785, mailed Nov. 29, 2012 (7 pages).

*Primary Examiner* — Omkar Deodhar
(74) *Attorney, Agent, or Firm* — Neal, Gerber & Eisenberg LLP

(57) ABSTRACT

A gaming system, gaming device, and method providing multiple simultaneously playable wagering games with individual credit balances. The gaming system: simultaneously displays a plurality of wagering games, each having a separate credit meter; simultaneously displays the credit meters of the wagering games; and enables a player to transfer credits from the credit meter of one wagering game to the credit meter of another wagering game. For each wagering game, the gaming system displays a total number of credits in the credit meter of that wagering game. The total number of credits includes a first sum of: any credits deposited into that credit meter, any credits won during play of that wagering game, and any credits transferred into that credit meter less a second sum of: any credits wagered during play of that wagering game, any credits transferred from that credit meter, and any credits cashed out of that credit meter.

87 Claims, 9 Drawing Sheets

(56) References Cited

U.S. PATENT DOCUMENTS

| | | | |
|---|---|---|---|
| 5,209,476 | A | 5/1993 | Eiba |
| 5,249,800 | A | 10/1993 | Hilgendorf et al. |
| 5,259,613 | A | 11/1993 | Marnell, II |
| 5,275,400 | A | 1/1994 | Weingardt et al. |
| 5,277,424 | A | 1/1994 | Wilms |
| 5,324,035 | A | 6/1994 | Morris et al. |
| 5,342,047 | A | 8/1994 | Heidel et al. |
| 5,344,144 | A | 9/1994 | Canon |
| 5,370,399 | A | 12/1994 | Liverance |
| 5,371,345 | A | 12/1994 | LeStrange et al. |
| 5,377,973 | A | 1/1995 | Jones et al. |
| 5,390,934 | A | 2/1995 | Grassa |
| 5,393,061 | A | 2/1995 | Manship et al. |
| 5,395,111 | A | 3/1995 | Inoue |
| 5,395,242 | A | 3/1995 | Slye et al. |
| 5,397,128 | A | 3/1995 | Hesse et al. |
| 5,411,258 | A | 5/1995 | Wilson et al. |
| 5,450,938 | A | 9/1995 | Rademacher |
| 5,470,079 | A | 11/1995 | LeStrange et al. |
| 5,472,194 | A | 12/1995 | Breeding et al. |
| 5,564,700 | A | 10/1996 | Celona |
| 5,569,084 | A | 10/1996 | Nicastro et al. |
| 5,570,885 | A | 11/1996 | Ornstein |
| 5,580,309 | A | 12/1996 | Piechowiak et al. |
| 5,584,764 | A | 12/1996 | Inoue |
| 5,593,349 | A | 1/1997 | Miguel et al. |
| 5,609,524 | A | 3/1997 | Inoue |
| 5,611,730 | A | 3/1997 | Weiss |
| 5,639,088 | A | 6/1997 | Schneider et al. |
| 5,655,961 | A | 8/1997 | Acres et al. |
| 5,674,128 | A | 10/1997 | Holch et al. |
| 5,697,843 | A | 12/1997 | Manship et al. |
| 5,704,835 | A | 1/1998 | Dietz, II |
| 5,707,286 | A | 1/1998 | Carlson |
| 5,722,891 | A | 3/1998 | Inoue |
| 5,761,647 | A | 6/1998 | Boushy |
| 5,770,533 | A | 6/1998 | Franchi |
| 5,775,692 | A | 7/1998 | Watts et al. |
| 5,816,915 | A | 10/1998 | Kadlic |
| 5,890,962 | A | 4/1999 | Takemoto |
| 5,947,820 | A | 9/1999 | Morro et al. |
| 5,967,896 | A | 10/1999 | Jorasch et al. |
| 5,984,779 | A | 11/1999 | Bridgeman et al. |
| 5,984,782 | A | 11/1999 | Inoue |
| 6,001,016 | A | 12/1999 | Walker et al. |
| 6,012,982 | A | 1/2000 | Piechowiak et al. |
| 6,024,642 | A | 2/2000 | Stupak |
| 6,033,307 | A | 3/2000 | Vancura |
| 6,039,648 | A | 3/2000 | Guinn et al. |
| 6,068,552 | A | 5/2000 | Walker et al. |
| 6,077,162 | A | 6/2000 | Weiss |
| 6,159,095 | A | 12/2000 | Frohm et al. |
| 6,186,894 | B1 | 2/2001 | Mayeroff |
| 6,190,255 | B1 | 2/2001 | Thomas et al. |
| 6,210,279 | B1 | 4/2001 | Dickinson |
| 6,227,971 | B1 | 5/2001 | Weiss |
| 6,254,481 | B1 | 7/2001 | Jaffe et al. |
| 6,264,561 | B1 | 7/2001 | Saffari et al. |
| 6,267,678 | B1 | 7/2001 | Kubo et al. |
| 6,270,412 | B1 | 8/2001 | Crawford et al. |
| 6,315,666 | B1 | 11/2001 | Mastera et al. |
| 6,319,125 | B1 | 11/2001 | Acres |
| 6,361,441 | B1 | 3/2002 | Walker et al. |
| 6,379,248 | B1 | 4/2002 | Jorasch et al. |
| 6,413,162 | B1 | 7/2002 | Baerlocher et al. |
| 6,431,983 | B2 | 8/2002 | Acres |
| 6,461,241 | B1 | 10/2002 | Webb et al. |
| 6,549,912 | B1 | 4/2003 | Chen |
| 6,554,709 | B1 | 4/2003 | Brenner et al. |
| 6,579,179 | B2 | 6/2003 | Poole et al. |
| 6,595,855 | B2 | 7/2003 | Sako |
| 6,607,441 | B1 | 8/2003 | Acres |
| 6,652,378 | B2 | 11/2003 | Cannon et al. |
| 6,656,040 | B1 | 12/2003 | Brosnan et al. |
| 6,832,957 | B2 | 12/2004 | Falconer |
| 6,835,134 | B2 | 12/2004 | Poole et al. |
| 6,837,788 | B2 | 1/2005 | Cannon |
| 6,860,810 | B2 | 3/2005 | Cannon et al. |
| 6,991,538 | B2 | 1/2006 | Cannon |
| 7,156,735 | B2 | 1/2007 | Brosnan et al. |
| 7,297,059 | B2 | 11/2007 | Vancura et al. |
| 7,341,518 | B2 | 3/2008 | Muskin |
| 7,594,851 | B2 | 9/2009 | Falconer |
| 7,758,417 | B2 | 7/2010 | Jorasch et al. |
| 7,780,517 | B2 | 8/2010 | Saffari et al. |
| 7,806,764 | B2 | 10/2010 | Brosnan et al. |
| 7,901,294 | B2 | 3/2011 | Walker et al. |
| 2002/0025850 | A1 | 2/2002 | Hafezi |
| 2002/0077167 | A1 | 6/2002 | Merari |
| 2003/0027628 | A1 | 2/2003 | Luciano |
| 2004/0043815 | A1 | 3/2004 | Kaminkow |
| 2004/0087369 | A1 | 5/2004 | Tanaka et al. |
| 2004/0152509 | A1 | 8/2004 | Hornik et al. |
| 2004/0192431 | A1 | 9/2004 | Singer et al. |
| 2004/0235542 | A1 | 11/2004 | Stronach et al. |
| 2005/0107158 | A1 | 5/2005 | Kanisawa et al. |
| 2005/0233794 | A1* | 10/2005 | Cannon et al. ..... 463/16 |
| 2006/0154722 | A1 | 7/2006 | Walker et al. |
| 2006/0252508 | A1 | 11/2006 | Walker et al. |
| 2007/0155482 | A1 | 7/2007 | Walker et al. |
| 2007/0293306 | A1 | 12/2007 | Nee et al. |
| 2008/0009334 | A1 | 1/2008 | Walker et al. |
| 2008/0102934 | A1 | 5/2008 | Tan |
| 2008/0176635 | A1 | 7/2008 | Randall |
| 2009/0117999 | A1* | 5/2009 | Johnson et al. ..... 463/26 |
| 2010/0016062 | A1 | 1/2010 | Baerlocher |
| 2010/0203966 | A1 | 8/2010 | Weiss |
| 2010/0222134 | A1 | 9/2010 | Gagner et al. |
| 2010/0248821 | A1 | 9/2010 | Jorasch et al. |
| 2011/0111842 | A1 | 5/2011 | Walker et al. |
| 2011/0218024 | A1 | 9/2011 | Baerlocher |

FOREIGN PATENT DOCUMENTS

| | | | |
|---|---|---|---|
| WO | WO 99/10849 | A1 | 3/1999 |
| WO | WO 01/82245 | A2 | 1/2001 |
| WO | WO 02/099760 | A2 | 12/2002 |
| WO | WO 2005/079242 | A2 | 9/2005 |

* cited by examiner

GAMING SYSTEM, GAMING DEVICE, AND METHOD PROVIDING MULTIPLE SIMULTANEOUSLY PLAYABLE WAGERING GAMES WITH INDIVIDUAL CREDIT BALANCES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming devices that provide players awards in primary or base games are well known. These gaming devices generally require a player to place a wager to activate a play of the primary game. In many of these gaming devices, any award or awards for a play of the primary game are based on the player obtaining a winning symbol or winning symbol combination in the play of the primary game and on the amount of the wager (e.g., the higher the wager, the higher the award). To increase player enjoyment and excitement, and to increase the popularity of gaming devices, gaming device manufacturers strive to provide players with new types of gaming devices that attract the player and keep the player entertained.

Various commercially available gaming devices enable players to play more than one wagering game simultaneously. Certain of these gaming devices enable players to play multiple plays of a same wagering game simultaneously, plays of different wagering games simultaneously, or both. One disadvantage of many of these gaming devices is that they include a single communal credit meter from which a player may place a wager on each of the simultaneously played wagering games. Additionally, these gaming devices display any awards associated with plays of each of the simultaneously played wagering games in the single communal credit meter. Since each of the simultaneously played wagering games is associated with the single communal credit meter, it is difficult for the player to quickly and easily discern the performance of the individual wagering games in relation to one another.

Providing a gaming device in which a player may play a plurality of plays of one or more wagering games at once does, however, enhance player enjoyment and excitement by reducing the boredom and monotony of playing a single play of the same wagering game several consecutive times at the same gaming device. Therefore, to increase player enjoyment and excitement, it is desirable to provide players with new types of gaming devices enabling simultaneous wagering game play that include new and different schemes and features. A continuing need thus exists to provide new and exciting gaming systems, devices, and methods providing simultaneous wagering game play.

SUMMARY

The present disclosure provides various embodiments of a gaming system, gaming device, and method providing multiple simultaneously playable wagering games with individual credit balances. In general, the gaming system simultaneously displays a plurality of wagering games and enables a player to simultaneously play the displayed wagering games. Each of the displayed wagering games has its own separate credit meter. The gaming system simultaneously displays the credit meters of the displayed wagering games.

In one embodiment, the gaming system enables a player to transfer credits from the displayed credit meter of one of the displayed wagering games to the displayed credit meter of another one of the displayed wagering games. For each of the displayed wagering games, the gaming system displays a total number of credits in the displayed credit meter of that displayed wagering game. The total number of credits includes a first sum of: (1) any credits deposited into that displayed credit meter, (2) any credits won during play of that displayed wagering game, and (3) any credits transferred into that displayed credit meter; less a second sum of: (1) any credits wagered on any plays of that displayed wagering game, (2) any credits transferred from that displayed credit meter, and (3) any credits cashed out of that displayed credit meter.

In certain embodiments, after receiving a deposit from a player, the gaming system enables the player to allocate the deposit to one or more of the displayed credit meters. In certain embodiments, after receiving a deposit from a player, the gaming system allocates the deposit to one or more of the displayed credit meters. In one of these embodiments, the gaming system allocates the deposit by at least one of: (a) allocating said deposit to one of the displayed credit meters, (b) evenly allocating said deposit among each of the displayed credit meters, (c) allocating said deposit based on the quantity of credits in each of the displayed credit meters, and (d) allocating said deposit such that the displayed credit meters are balanced.

In certain embodiments, the gaming system reports a combination of each of the credit meters to a central controller or a host as a single displayed credit meter.

In some embodiments, the gaming system displays a total credit meter in addition to the displayed credit meters of the displayed wagering games. In these embodiments, the displayed total credit meter displays a running total of the credits included in each of the displayed credit meters.

In various embodiments, the gaming system displays a holding meter separate from the displayed credit meters. In certain of these embodiments, after receiving a deposit from a player, the gaming system allocates the deposit to the displayed holding meter and displays the deposit in the displayed holding meter. In certain of these embodiments, the gaming system enables the player to transfer credits from the holding meter to one or more of the displayed credit meters. In certain of these embodiments, the gaming system enables the player to transfer credits from one or more of the displayed credit meters to the displayed holding meter.

Additional features and advantages are described herein, and will be apparent from, the following Detailed Description and the Figures.

DETAILED DESCRIPTION

Gaming Device and Electronics

The present disclosure may be implemented in various configurations for gaming machines, gaming devices, or gaming systems, including but not limited to: (1) a dedicated gaming machine, gaming device, or gaming system wherein the computerized instructions for controlling any games (that are provided by the gaming machine or gaming device) are provided with the gaming machine or gaming device prior to delivery to a gaming establishment; and (2) a changeable gaming machine, gaming device, or gaming system wherein the computerized instructions for controlling any games (that are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces), and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling the base or primary game of the present disclosure are communicated from the central server to the gaming device in a thick client configuration and computerized instructions for controlling any secondary or bonus games or functions are executed by a central server in a thin client configuration.

Figure 1A:
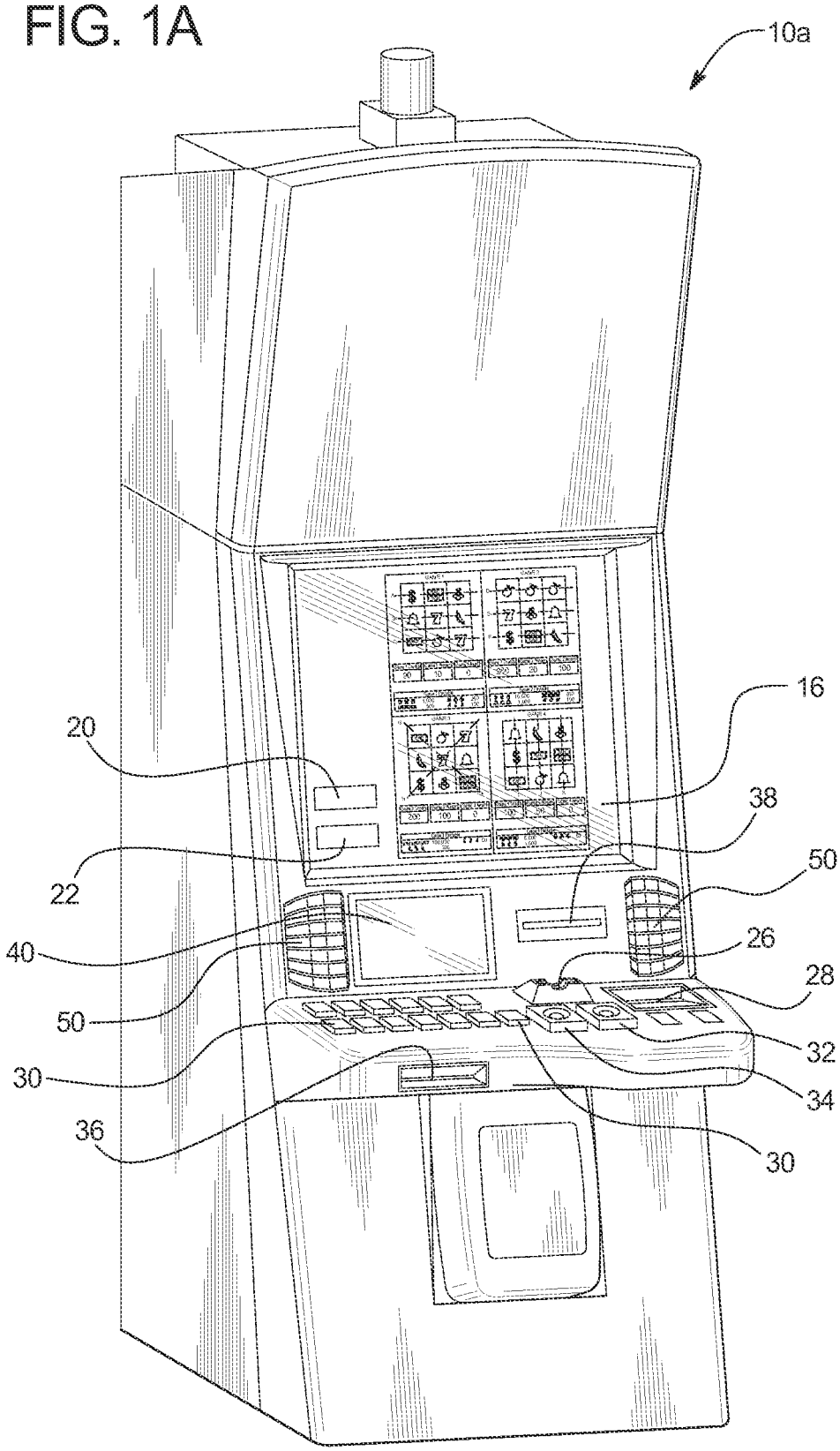
FIGS. 1A and 1B are perspective views of example alternative embodiments of the gaming device of the present disclosure.

Referring now to the drawings, two example alternative embodiments of a gaming device disclosed herein are illustrated in FIGS. 1A and 1 B as gaming device 10*a* and gaming device 10*b*, respectively. Gaming device 10*a* and/or gaming device 10*b* are generally referred to herein as gaming device 10.

Figure 1B:
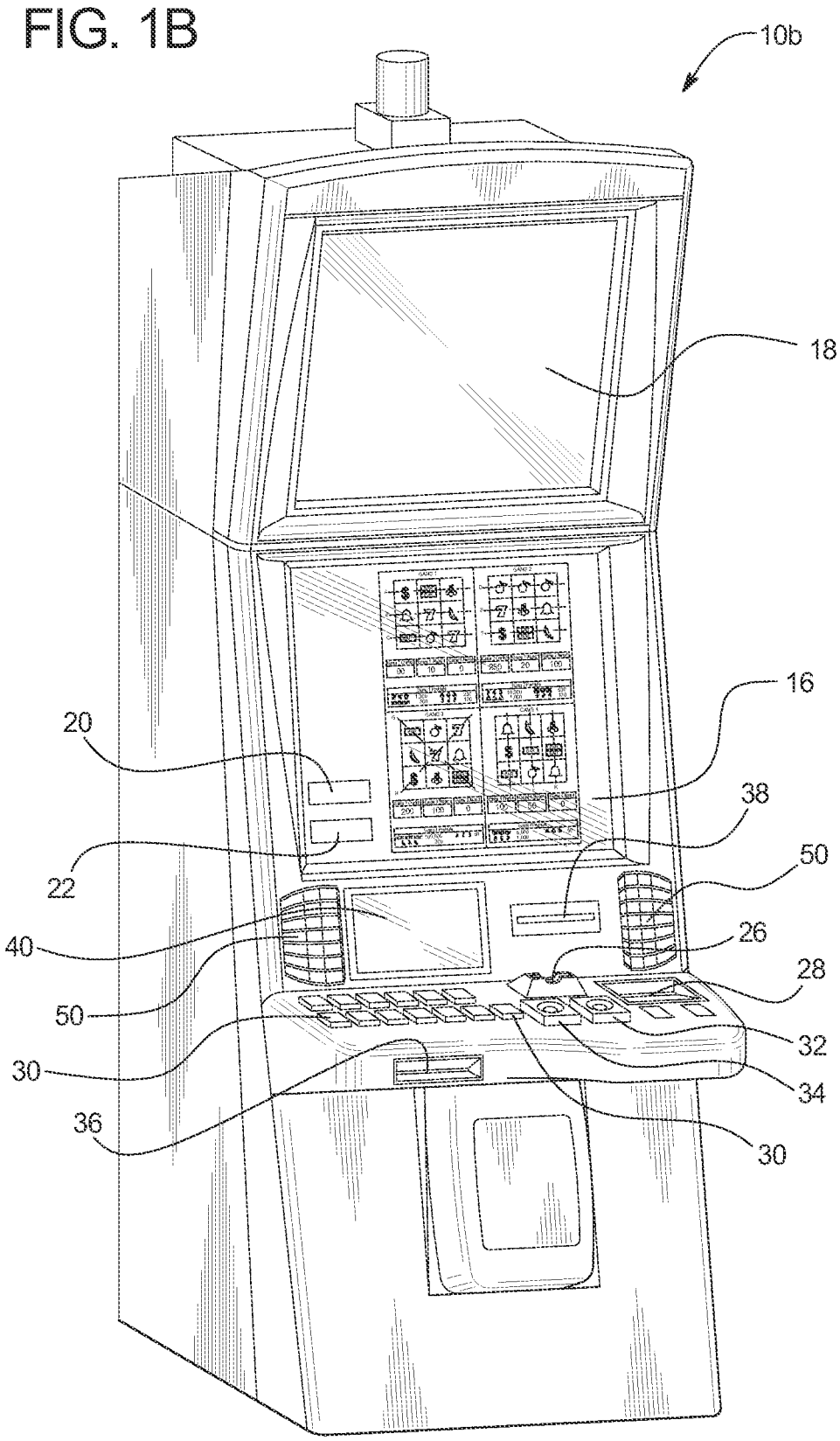

In the embodiments illustrated in FIGS. 1A and 1B, gaming device 10 has a support structure, housing, or cabinet that provides support for a plurality of displays, inputs, controls, and other features of a conventional gaming machine. It is configured so that a player may operate it while standing or sitting. The gaming device may be positioned on a base or stand or may be configured as a pub-style table-top game (not shown) that a player may operate preferably while sitting. As illustrated by the different configurations shown in FIGS. 1A and 1B, the gaming device may have varying cabinet and display configurations.

Figure 2A:
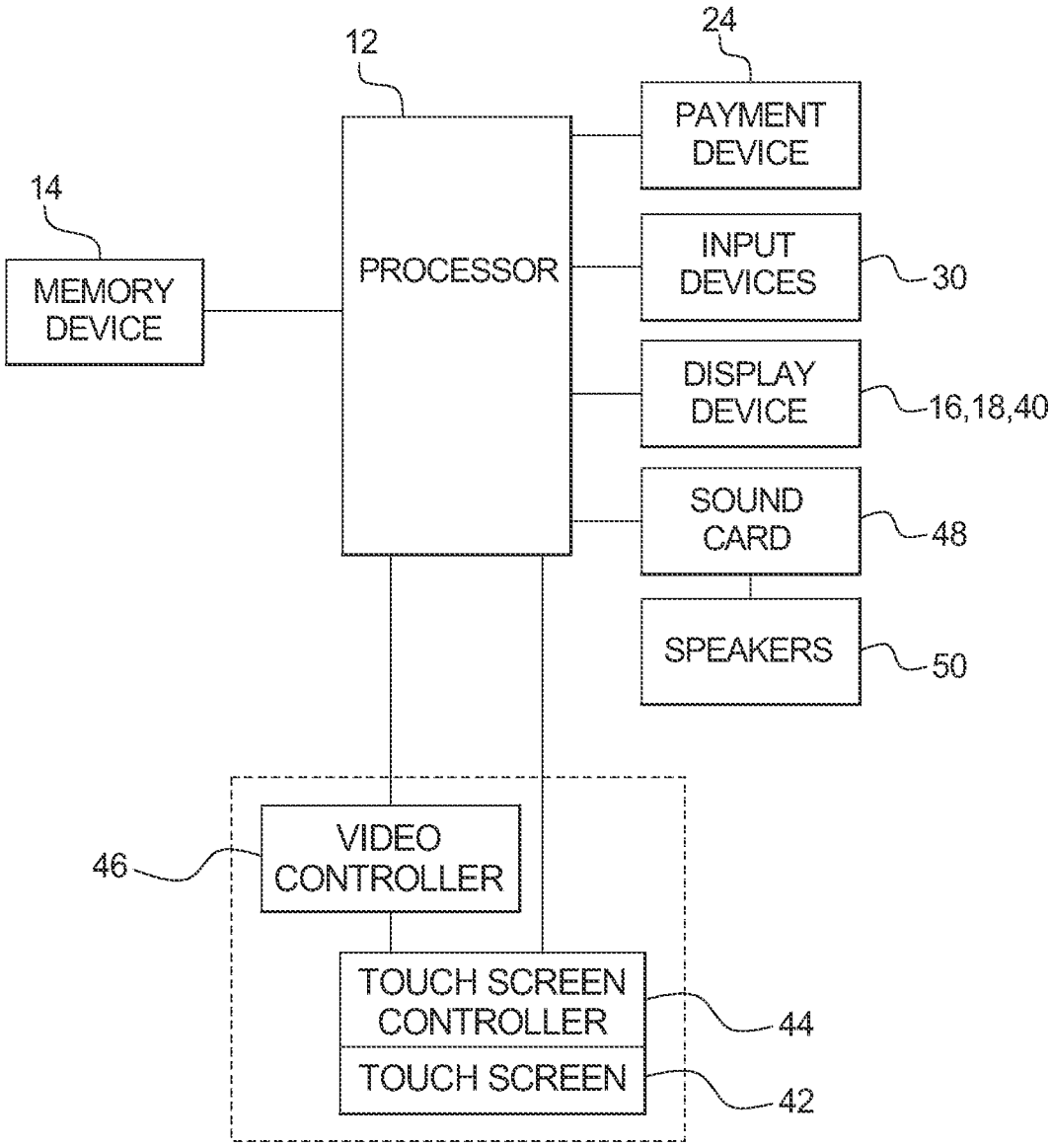
FIG. 2A is a schematic block diagram of one embodiment of an electronic configuration for one of the gaming devices disclosed herein.

In one embodiment, as illustrated in FIG. 2A, the gaming device includes at least one processor 12, such as a microprocessor, a microcontroller-based platform, a suitable integrated circuit, or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, such as, but not limited to, a suitable cartridge, disk, CD ROM, DVD, non-transitory computer readable medium, or USB memory device. In other embodiments, part or all of the program code and/or operating data described above may be downloaded to the memory device through a suitable network.

In one embodiment, an operator or a player may use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, such as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 that displays any suitable base or primary game. This display device may also display any suitable secondary or bonus game associated with the base or primary game as well as information relating to the base or primary game or the secondary or bonus game. The alternative embodiment shown in FIG. 1B includes a central display device 16 and an upper display device 18. The upper display device may display the base or primary game, any suitable secondary or bonus game associated or not associated with the base or primary game, and/or information relating to the base or primary game or the secondary or bonus game. These display devices may also serve as digital glass operable to advertise games or other aspects of the gaming establishment. As shown in FIGS. 1A and 1B, in one embodiment, the gaming device includes a credit display 20 that displays a player's current number of credits, cash, account balance, or the equivalent. In one embodiment, the gaming device includes a bet display 22 that displays a player's amount wagered. In one embodiment, as discussed in more detail below, the gaming device includes a player tracking display 40 that displays information regarding a player's play tracking status.

In another embodiment, at least one display device may be a mobile display device, such as a PDA or tablet PC, that enables play of at least a portion of the base or primary game or the secondary or bonus game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle, or an elongated rectangle.

The display devices of the gaming device are configured to display at least one and preferably a plurality of game or other suitable images, symbols, and indicia such as any visual representation or exhibition of the movement of objects such as mechanical, virtual, or video reels and wheels; dynamic lighting; video images; images of people, characters, places, things, or faces of cards; and the like.

In one alternative embodiment, the symbols, images, and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As shown in FIGS. 1A and 1B, a payment device such as a payment acceptor includes a note, ticket, or bill acceptor 28, into which the player inserts paper money, a ticket, or voucher and a coin slot 26 into which the player inserts money, coins, or tokens. In other embodiments, payment devices such as readers or validators for credit cards, debit cards, or credit slips may accept payment. In one embodiment, a player may insert an identification card into a card reader of the gaming device. In one embodiment, the identification card is a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, that communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As shown in FIGS. 1A, 1B, and 2A, in one embodiment the gaming device includes at least one and preferably a plurality of input devices 30 in communication with the processor. The input devices may include any suitable device that enables the player to produce an input signal that is received by the processor. In one embodiment, after appropriate funding of the gaming device, the input device is a game activation device, such as a play button 32 or a pull arm (not shown) that is used by the player to start the base or primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player may increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown)

that enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as shown in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as shown in FIG. 2A, the gaming device includes a sound generating device controlled by one or more sound cards 48 that function in conjunction with the processor. In one embodiment, the sound generating device includes at least one and preferably a plurality of speakers 50 or other sound generating hardware and/or software for generating sounds, such as by playing music for the base or primary game and/or the secondary or bonus game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera and to display the visible manifestation of the game in split screen or picture-in-picture fashion. For example, the camera may acquire an image of the player and the processor may incorporate that image into the base or primary game and/or the secondary or bonus game as a game image, symbol, or indicia.

Gaming device 10 incorporates the base or primary game and any secondary or bonus game associated with the base or primary game. The gaming machine or device may include some or all of the features of conventional gaming machines or devices. The gaming device may incorporate any suitable reel-type game, card game, cascading or falling symbol game, number game, or other game of chance susceptible to representation in an electronic or electromechanical form as a secondary or bonus game or feature, which in one embodiment produces a random outcome based on probability data at the time of or after placement of a wager. That is, different base or primary games or secondary or bonus games, such as video poker games, video blackjack games, video keno games, and video bingo games may be implemented.

In one embodiment, the base or primary game and/or the secondary or bonus game includes one or more paylines associated with a plurality of symbol display positions. The paylines may be horizontal, vertical, circular, diagonal, angled, or any combination thereof. In this embodiment, the gaming device includes at least one and preferably a plurality of reels, such as three to five reels, in either electromechanical form with mechanical rotating reels or video form with simulated reels and movement thereof. In one embodiment, an electromechanical slot machine includes a plurality of adjacent, rotatable reels that may be combined and operably coupled with an electronic display of any suitable type. In another embodiment, if the reels are in video form, one or more of the display devices, as discussed above, displays the plurality of simulated video reels. Each reel displays a plurality of indicia or symbols, such as bells, hearts, fruits, numbers, letters, bars, or other images that preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels stop spinning if specified types and/or configurations of indicia or symbols occur on an active payline or otherwise occur in a winning pattern, occur on the requisite number of adjacent reels, and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols that are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if a reel is activated based on the player's wager, then each of the symbol positions of that reel will be activated and each of the active symbol positions will be part of one or more of the ways to win. In one embodiment, if a reel is not activated based on the player's wager, then a designated number of default symbol positions, such as a single symbol position of the middle row of the reel, will be activated and the default symbol position(s) will be part of one or more of the ways to win. This type of gaming machine enables a player to wager on one, more than one, or all of the reels, and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols that form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols that were previously classified or formed from related symbols on the first and second reels.

After analyzing each of the remaining strings of related symbols, the gaming device determines, for each remaining pending or incomplete string of related symbols, if any of the symbols from the next adjacent reel should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, base or primary game or the secondary or bonus game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table that utilizes conventional poker hand rankings to determine the winning hands. The gaming device provides the player with an award based on a winning hand and the number of credits the player wagered.

In another embodiment, the base or primary game or the secondary or bonus game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, the base or primary game or the secondary or bonus game may be a keno game wherein the gaming device displays a plurality of selectable indicia or numbers on at least one of the display devices. In this embodiment, the player selects at least one of a plurality of the selectable indicia or numbers via an input device such as a touch screen. The gaming device then displays a series of drawn numbers and determines an amount of matches, if any, between the player's selected numbers and the gaming device's drawn numbers. The player is provided an award based on the amount of matches, if any, based on the amount of determined matches and the number of numbers drawn.

In one embodiment, as noted above, in addition to winning credits or other awards in the base or primary game, the gaming device may also give players the opportunity to win credits in a secondary or bonus game or in a secondary or bonus round. The secondary or bonus game enables the player to obtain a prize or payout in addition to the prize or payout, if any, obtained from the base or primary game. In general, a secondary or bonus game produces a significantly higher level of player excitement than the base or primary game because it provides a greater expectation of winning than the base or primary game, and is accompanied with more attractive or unusual features than the base or primary game. In one embodiment, the secondary or bonus game may be any type of suitable game, either similar to or completely different from the base or primary game.

In one embodiment, the triggering event or qualifying condition may be a selected outcome in the base or primary game or a particular arrangement of one or more indicia on a display device in the base or primary game, such as a BONUS symbol appearing on three adjacent reels along a payline in the base or primary game. In other embodiments, the triggering event or qualifying condition occurs based on exceeding a certain amount of game play (such as number of games, number of credits, amount of time), or reaching a specified number of points earned during game play.

In another embodiment, gaming device processor 12 or central controller 56 randomly provides the player one or more plays of one or more secondary or bonus games. In one such embodiment, the gaming device does not provide any apparent reason to the player for qualifying to play a secondary or bonus game. In this embodiment, qualifying for a secondary or bonus game is not triggered by an event in or based specifically on any of the plays of the base or primary game. That is, the gaming device may simply qualify a player to play a secondary or bonus game without any explanation or alternatively with simple explanations. In another embodiment, the gaming device (or central server) qualifies a player for a secondary or bonus game at least partially based on a game triggered or symbol triggered event, such as at least partially based on the play of the base or primary game.

In one embodiment, the gaming device includes a program that will automatically begin a secondary or bonus round after the player has achieved a triggering event or qualifying condition in the base or primary game. In another embodiment, after a player has qualified for a secondary or bonus game, the player may subsequently enhance the player's secondary or bonus game participation through continued play of the base or primary game. Thus, for each secondary or bonus qualifying event, such as a bonus symbol, that the player obtains, a given number of secondary or bonus game wagering points or credits may be accumulated in a "bonus meter" programmed to accrue the secondary or bonus wagering credits or entries toward eventual participation in a secondary or bonus game. The occurrence of multiple such secondary or bonus qualifying events in the base or primary game may result in an arithmetic or exponential increase in the number of secondary or bonus wagering credits awarded. In one embodiment, the player may redeem extra secondary or bonus wagering credits during the secondary or bonus game to extend play of the secondary or bonus game.

In one embodiment, no separate entry fee or buy-in for a secondary or bonus game is needed. That is, a player may not purchase entry into a secondary or bonus game; rather, the player must win or earn entry through play of the base or primary game, thus encouraging play of the base or primary game. In another embodiment, qualification of the secondary or bonus game is accomplished through a simple "buy-in" by the player—for example, if the player has been unsuccessful at qualifying through other specified activities. In another embodiment, the player must make a separate side-wager on the secondary or bonus game or wager a designated amount in the base or primary game to qualify for the secondary or bonus game. In this embodiment, the secondary or bonus game triggering event must occur and the side-wager (or designated base or primary game wager amount) must have been placed to trigger the secondary or bonus game.

Figure 2B:
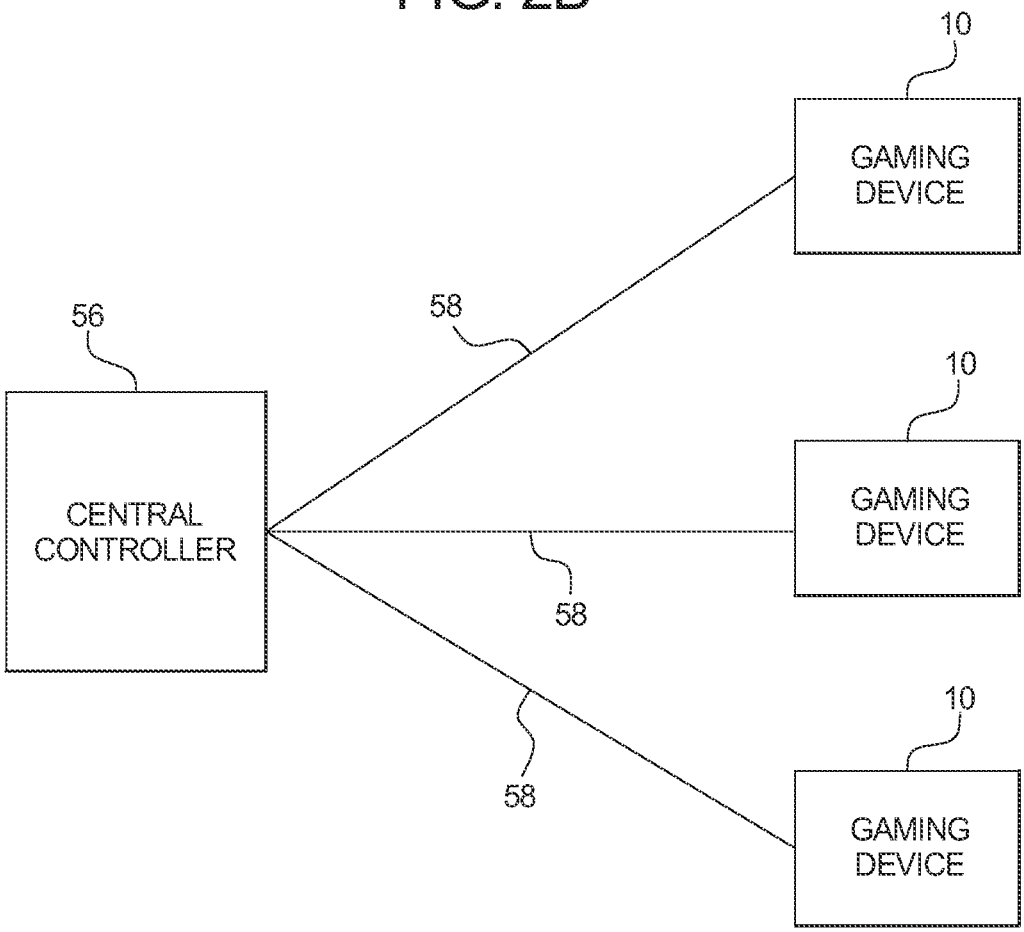
FIG. 2B is a schematic block diagram of one embodiment of a network configuration for a plurality of gaming devices disclosed herein.

In one embodiment, as illustrated in FIG. 2B, one or more of gaming devices 10 are in communication with each other and/or at least one central controller 56 through a data network or remote communication link 58. In this embodiment, the central server, central controller, or remote host is any suitable server or computing device that includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more, or each of the functions of the central controller, central server, or remote host as disclosed herein may be performed by one or more gaming device processors. It should be further appreciated that one, more, or each of the functions of one or more gaming device processors as disclosed herein may be performed by the central controller, central server, or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the base or primary game based on probability data. In another embodiment, the central server or controller randomly generates a game outcome for the secondary or bonus game based on probability data. In another embodiment, the central server or controller randomly generates a game outcome for both the base or primary game and the secondary or bonus game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a base or primary game outcome, a secondary or bonus game outcome, base or primary game and secondary or bonus game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the base or primary game or the secondary or bonus game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10, which will be provided to a first player regardless of how the first player plays in a first game, and a second gaming device to have selected elements marked in a different predetermined pattern is provided a second outcome of win $2, which will be provided to a second player regardless of how the second player plays a second game. It should be appreciated that as the process of marking selected elements continues until one or more predetermined patterns are marked, this embodiment ensures that at least one bingo card will win the bingo game, and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card that has an encoded player identification number that uniquely identifies the player. When a player inserts the player's playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes the player's player tracking card when concluding play for that gaming session. In another embodiment, rather than requiring a player to insert a player tracking card, the gaming device utilizes one or more portable devices carried by a player, such as a cell phone, a radio frequency identification tag, or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) that are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device that includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game that may be played on one or more of the gaming devices in the gaming system. Such different games may include the same or substantially the same game play with different pay tables. In different embodiments, the executable game program is for the base or primary game, a secondary or bonus game, or both. In another embodiment, the game program may be executable as a secondary or bonus game to be played simultaneous with the play of the base or primary game (that may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate the base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of the base or primary game. That is, a player is provided a progressive award without any explanation or, alternatively, with simple explanations. In another embodiment, a player is provided a progressive award at least partially based on a game triggered or symbol triggered event, such as at least partially based on the play of the base or primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager any credit amount during the base or primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the base or primary game of the gaming machines in the gaming system, via a gaming establishment or via any suitable manner.

In another embodiment, one or more of the progressive awards are partially funded via a side-bet or side-wager that the player may make (and that may be tracked via a side-bet meter). In one embodiment, one or more of the progressive awards are funded with only side-bets or side-wagers placed. In another embodiment, one or more of the progressive awards are funded based on players' wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the base or primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, among the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Multiple Simultaneously Playable Wagering Games with Individual Credit Balances The present disclosure provides a gaming system, gaming device, and method providing multiple simultaneously playable wagering games with individual credit balances (sometimes referred to herein as the "gaming system," "gaming device," or "method"). In general, the gaming system simultaneously displays a plurality of wagering games and enables a player to simultaneously play the displayed wagering games. The displayed wagering games may be any suitable wagering games such as, but not limited to, slot or spinning reel games; video slot or spinning reel games; video poker, video blackjack, or other video card games; video bingo games; video keno games; video roulette games; or any suitable combination thereof. Each of the displayed wagering games has its own separate credit meter. The gaming system simultaneously displays the credit meters of the displayed wagering games.

The gaming system enables the player to move or transfer credits from the displayed credit meters of one or more of the displayed wagering games to the displayed credit meters of one or more of the other displayed wagering games. For example, if a first displayed credit meter of a first displayed wagering game includes 500 credits and a second displayed credit meter of a second displayed wagering game includes 0 credits, the player may, for example, transfer 250 credits (or any other suitable quantity of credits) from the first displayed credit meter to the second displayed credit meter. After the credits are transferred, in this example the first displayed credit meter and the second displayed credit meter each include 250 credits.

In various embodiments, the gaming system enables the player to transfer credits from at least one of the displayed credit meters to one or more of the other displayed credit meters: (a) at any time; (b) at a predetermined time or times; (c) when the displayed credit meter(s) from which credits are to be transferred includes at least a predetermined quantity of credits; (d) when the displayed credit meter(s) to which credits are to be transferred includes fewer than a predetermined quantity of credits; (e) when the displayed wagering game(s) having the displayed credit meter(s) from which the credits are to be transferred is not being played; (f) when the displayed wagering game(s) having the displayed credit meter (s) to which the credits are to be transferred is not being played; (g) when a wagering game is added to the displayed wagering games; (h) when one of the displayed wagering games is removed; or (i) any suitable combination thereof.

In various embodiments, the gaming system enables the player to transfer: (a) any quantity of credits; (b) a predetermined quantity of credits; (c) no more than a predetermined quantity of credits; (d) no less than a predetermined quantity of credits; (e) no more than a designated percentage of the credits included in a given one of the displayed credit meters; (f) no less than a designated percentage of the credits included in a given one of the displayed credit meters; (g) some or all of any credits awarded for one or more plays of one or more of the displayed wagering games; or (h) any suitable combination thereof.

The player may effectuate the transfer of credits between or among two or more of the displayed credit meters in any suitable manner. In one embodiment, for example, the gaming system includes or displays (as in the case of a touch screen display) a dedicated button, such as a "TRANSFER CREDITS" button, which, when actuated by the player, enables the player to transfer credits between or among two or more of the displayed credit meters. In this embodiment, after the player actuates the "TRANSFER CREDITS" button, the gaming system prompts the player to indicate: (1) one or more of the displayed credit meters from which the player wishes to transfer credits, (2) a quantity of credits that the player wishes to transfer from each of the indicated displayed credit meters, and (3) to which of the displayed credit meters the player wishes to transfer those credits. The player may indicate the quantity of credits to transfer in any suitable manner, such as by using a slider bar or keyboard to enter a quantity or by actuating a button associated with a predetermined quantity of credits. In another embodiment in which the gaming system includes a touch screen, the gaming system enables the player to "drag and drop" credits from one displayed credit meter to another displayed credit meter. For example, a player may drag one displayed credit meter from the game play area of a first one of the displayed wagering games into the game play area of a second one of the displayed wagering games to indicate that the player wishes to transfer credits from the credit meter of the first one of the displayed wagering games to the credit meter of the second one of the displayed wagering games. The gaming system may then prompt the player to indicate the quantity of credits the player wishes to transfer, and the player may so indicate in any suitable manner (such as one of the manners described above).

For each of the displayed wagering games, the gaming system displays a total number of credits in the displayed credit meter of that displayed wagering game. The total number of credits includes a first sum of: (1) any credits deposited into that displayed credit meter, (2) any credits won during play of that displayed wagering game, and (3) any credits transferred into that displayed credit meter; less a second sum of: (1) any credits wagered on any plays of that displayed wagering game, (2) any credits transferred from that displayed credit meter, and (3) any credits cashed out of that displayed credit meter. In certain embodiments, the gaming system displays a total credit meter in addition to the displayed credit meters of the displayed wagering games. In these embodiments, the displayed total credit meter displays a running total of the credits included in each of the displayed credit meters.

The gaming system essentially operates each displayed wagering game separately from the other displayed wagering games as if that displayed wagering game was the only wagering game being operated by the gaming system. This enables a player to quickly and easily visually compare how the displayed wagering games are performing in relation to one another by looking at the displayed credit meters. For example, it enables a player to determine which of the displayed wagering games are "hot" or "cold," or to determine which of the displayed wagering games the player likes or dislikes based, for example, on the quantity of credits won while playing those wagering games. The gaming system, therefore, increases player enjoyment and excitement by providing the player an opportunity to play a variety of wagering games simultaneously while enabling the player to quickly and easily keep track of the wagering and awards associated with each of the simultaneously displayed wagering games.

In one embodiment, when a player deposits currency into the gaming system, the player chooses to which of the displayed credit meters the gaming system will apply the deposited currency. In one example, a player deposits $20 into a gaming system including a first displayed wagering game having a first displayed credit meter and a second displayed wagering game having a second displayed credit meter. After receiving the deposit, in this embodiment the gaming system prompts the player as to how the player wishes to allocate or distribute the deposited $20. The player may indicate (using, for example, a slider interface or one or more dedicated buttons) how much of the deposited currency to allocate to each of the displayed credit meters. In this example, if the player indicates that the player wishes to allocate equal amounts of the deposited currency to each of the displayed credit meters, $10 in credits will be added to the first displayed credit meter and $10 worth of credits will be added to the second displayed credit meter. For example, if one of the displayed wagering games is configured such that 1 credit represents $1, and another one of the displayed wagering games is configured such that 2 credits represent $1, the gaming system will add 10 credits and 20 credits to the respective displayed credit meters. It should be appreciated that, in certain embodiments, the gaming system stores the player's choice as to how deposits should be split between or among the displayed credit meters and applies that same choice to future currency deposits of the same amount or, in some embodiments, of different amounts. For instance, in this example embodiment, the next time the player deposits $20, the gaming system will automatically allocate $10 to the first displayed credit meter and $10 to the second displayed credit meter.

In another embodiment, when a player deposits currency into the gaming system the gaming system allocates the entire deposit to one of the displayed credit meters. The player may then transfer credits from that displayed credit meter to one or more of the other displayed credit meters in one or more of the manners described above if the player so desires. It should be appreciated that the gaming system determines to which of the displayed credit meters the gaming system will allocate the deposited currency in any suitable manner. In one embodiment, the gaming system allocates the deposited currency to a randomly chosen one of the displayed credit meters. In another embodiment, the gaming system allocates the deposited currency to a predetermined one of the displayed credit meters. In another embodiment, the player preselects one or more of the displayed credit meters to which the gaming system allocates each deposit.

In another embodiment, when a player deposits currency into the gaming system the gaming system allocates the deposited currency evenly (or as evenly as possible) between or among each of the displayed credit meters. For example, if the player is playing two displayed wagering games (each having a separate displayed credit meter) and deposits $20, half of the $20 (i.e., equal $10 amounts) will be allocated to each of the displayed credit meters. If, however, the player is playing three displayed wagering games (each having a separate displayed credit meter) and deposits $20, in one embodiment the gaming system allocates a lesser amount to at least one of the displayed credit meters than it does to another one of the displayed credit meters. It should be appreciated that the gaming system determines which of the displayed credit meters is allocated the lesser amount in any suitable manner, such as randomly or by prompting the player for a choice of one of the displayed credit meters to which the lesser (or greater) amount will be allocated.

In another embodiment, when a player deposits currency into the gaming system the gaming system allocates the deposited currency such that the displayed credit meters are as balanced as possible after the deposited currency is allocated. For example, if the player is playing two displayed wagering games, a first one of which has a first displayed credit meter including $10 worth of credits and a second one of which has a second displayed credit meter including $30 worth of credits, and the player deposits $20, the gaming system allocates the deposited $20 to the first displayed credit meter in order to balance the displayed credit meters. More specifically, after the allocation of the deposited $20 to the first displayed credit meter, each of the displayed credit meters includes $30 worth of credits. It should be appreciated that, in some embodiments, the gaming system balances the displayed credit meters by balancing the number of credits included in the displayed credit meters rather than the currency value of those credits. In another embodiment, the gaming system takes the cycle times of the displayed wagering games into account when allocating deposited currency to balance the displayed credit meters. For example, if a first one of the displayed wagering games has a cycle time that is twice as fast as a second one of the displayed wagering games, the gaming system allocates twice as much of the deposited currency to the displayed credit meter of the first one of the displayed wagering games than it allocates to the displayed credit meter of the second one of the displayed wagering games because, for a given period of time, the first one of the displayed wagering games will be played twice as many times (and thus use an average of twice as many credits) as the second one of the displayed wagering games. In another embodiment, the gaming system takes the rate at which the displayed credit meters are losing credits into account when allocating deposited currency to balance the displayed credit meters. For example, the gaming system may determine that a first one of the displayed credit meters of a first displayed wagering game is losing credits twice as fast as a second one of the displayed credit meters of a second displayed wagering game. In this case, the gaming system allocates twice as much of the deposited currency to the first one of the displayed credit meters than it allocates to the second one of the displayed credit meters because, for a given period of time, the player loses twice as many credits while playing the first displayed wagering game than the player does playing the second displayed wagering game. It should be appreciated that the gaming system may balance the credit meters using one or both of a game state of one or more of the wagering games and a game logic of one or more of the wagering games.

In certain embodiments, the gaming system enables a player to cash out each displayed credit meter individually. In one of these embodiments, when the player cashes out of one of the displayed credit meters, the credits included in that displayed credit meter are provided to the player via a payment device (such as via a ticket printer, via an electronic funds transfer, or via any other of the payment methods described above). In another one of these embodiments, when the player cashes out of one of the displayed credit meters, the credits included in that displayed credit meter are transferred to one or more of the other displayed credit meters. In this embodiment, the player cashes out of each of the displayed credit meters in order to receive payment.

In certain embodiments, the gaming system displays or includes a holding meter that is separate from the displayed credit meters. The holding meter acts as a storage area for credits (or currency). In one embodiment, when a player deposits currency into the gaming system the currency is allocated to the holding meter. The player may then transfer the currency from the holding meter to one or more of the displayed credit meters in a manner similar to those described above with respect to the transfer of credits from one credit meter to another. In another embodiment, the gaming system enables the player to transfer credits from one or more of the displayed credit meters to the holding meter in a manner similar to those described above with respect to the transfer of credits from one credit meter to another. In certain of the embodiments including a holding meter, the player may cash out credits included in the holding meter. Thus, in these embodiments, the player transfers credits from the displayed credit meters to the holding meter in order to cash out those credits. In another embodiment, when the player cashes out one of the displayed credit meters, the credits included in that displayed credit meter are automatically transferred to the holding meter and the player may then cash out the credits from the holding meter. In another embodiment, when the player cashes out of one of the displayed credit meters, the gaming system prompts the player whether the player wishes to transfer all, a portion of, or none of the credits included in that displayed credit meter to the holding meter and/or whether the player wishes to transfer all, a portion of, or none of the credits included in that displayed credit meter to another one of the displayed credit meters.

It should be appreciated that, in certain embodiments, the gaming system reports the combination of the displayed credit meters as a single credit meter to a host or central server, such as a casino server in one example. Thus, in these embodiments, the host or central server does not have knowledge of the multiple displayed credit meters.

It should be appreciated that the quantity of wagering games that are simultaneously displayed may be determined in any suitable manner. In one embodiment, the gaming system enables a player to select up to a predetermined quantity of wagering games to simultaneously display. In certain embodiments, the quantity of wagering games that are simultaneously displayed is predetermined. For example, in one of these embodiments the gaming system always displays four wagering games simultaneously, although it should be appreciated that any suitable predetermined quantity of wagering games that are simultaneously displayed may be employed. In other embodiments, the quantity of wagering games that are simultaneously displayed is based on an amount of a deposit or deposits placed by the player. For example, in one of these embodiments the gaming system offers the player an opportunity to play more than one wagering game simultaneously if the player deposits at least a predetermined amount of currency. In another one of these embodiments, the more the player deposits, the larger the quantity of wagering games the gaming system offers the player to simultaneously play. In another embodiment, the gaming system determines the quantity of wagering games that are simultaneously displayed based on information stored in a player tracking database. For example, if the player tracking database includes information indicating that a certain player frequently plays four wagering games simultaneously, the gaming system offers the player the opportunity to play four wagering games simultaneously when the player deposits currency into the gaming system.

In certain other embodiments, the gaming system provides the plurality of simultaneously displayed wagering games as a bonus game. In one of these embodiments, certain designated outcomes of a primary game trigger the bonus game. In one example, one of the designated outcomes triggers a bonus game including two simultaneously displayed wagering games, another one of the designated outcomes triggers a bonus game including four simultaneously displayed wagering games, and another one of the designated outcomes triggers a bonus game including eight simultaneously displayed wagering games. It should be appreciated that, in various embodiments, the simultaneously displayed wagering games in the bonus game are: (a) operable upon wagers by the player, (b) operable upon wagers using bonus game credits provided to and/or accumulated by the player, (c) automatically provided upon entry into the bonus game, or (d) provided in any other suitable manner.

It should also be appreciated that the wagering games that are simultaneously displayed and played may be determined in any suitable manner. In certain embodiments, the wagering games that are simultaneously displayed are predetermined. For example, in one of these embodiments the gaming system includes four wagering games that are simultaneously displayed: (1) a video spinning reel wagering game, (2) a video roulette wagering game, (3) a video keno wagering game, and (4) a video poker wagering game. In other embodiments, the gaming system includes a bank of wagering games from which the wagering games that are simultaneously displayed are selected. In one of these embodiments, the gaming system enables the player to select one or more of the wagering games in the bank of wagering games to be included in the wagering games that are simultaneously displayed. In various other embodiments, the gaming system determines at least one of the wagering games in the bank of wagering games to include in the wagering games that are simultaneously displayed: (a) randomly, (b) based on one or more deposits made by the player, (c) based on player tracking information, or (d) based on any other suitable parameter.

It should further be appreciated that any suitable types of wagering games that may be simultaneously displayed and played. In certain embodiments, two or more of the wagering games that are simultaneously displayed are a same wagering game. In one of these embodiments, at least two of the same displayed wagering game have the same average expected payout and the same volatility. In another one of these embodiments, at least two of the same displayed wagering game have the same average expected payout and different volatilities. In another one of these embodiments, at least two of the same displayed wagering game have different average expected payouts and the same volatility. In another one of these embodiments, at least two of the same displayed wagering game have different average expected payouts and different volatilities. In certain of these embodiments, at least two of the same displayed wagering game have the same bonus opportunities (such as bonus games or bonus payouts), while in other of these embodiments, at least two of the same displayed wagering game have different bonus opportunities. It should be appreciated that the different bonus opportunities may affect one or both of the average expected payout and the volatility of the displayed wagering game.

In general, volatility pertains to the range of the values of the awards provided for a wagering game. In one embodiment, for example, the highest and the lowest award values of a paytable for a first wagering game are higher and lower, respectively, than the highest and the lowest award value of a paytable for a second wagering game having the same or substantially the same average expected payback as the first wagering game. In this example, the paytable of the first wagering game has a higher volatility than the paytable of the second wagering game because it has higher and lower extreme values. In another example, a first paytable may provide awards of a smaller or moderate size on a relatively frequent basis and a second paytable provides higher awards that are provided less frequently. In this example, the second paytable has a higher volatility than the first paytable because the player wins less frequently and, when the player does win, the player receives relatively higher awards. The award disparity creates enhanced levels of excitement for a player because the player can obtain a large award by playing with a more volatile paytable. The gaming system of the present disclosure thus enables the player to play certain wagering games having more volatile paytables to take advantage of this excitement and the potential for large awards while enabling the player to also play certain wagering games having less volatile paytables to offset the potential for large swings in credits caused by the more volatile wagering games.

In certain embodiments, at least two of the displayed wagering games are the same wagering game, but have different credit denominations. For example, one of the displayed wagering games may be a $0.01 version of a wagering game (in which, for example, 1 credit represents $0.01), another one of the displayed wagering games may be a $0.05 version of that wagering game (in which, for example, 1 credit represents $0.05), another one of the displayed wagering games may be a $0.25 version of that wagering game (in which, for example, 1 credit represents $0.25), and another one of the displayed wagering games may be a $1 version of that wagering game (in which, for example, 1 credit represents $1). These different versions of the same wagering game may also have different average expected paybacks. In one embodiment, the higher the denomination, the higher the average expected payback. Continuing with the above example, the $0.01 version of the wagering game has the lowest average expected payback, the $0.05 version of the wagering game has the second lowest average expected payback, the $0.25 version of the wagering game has the second highest average expected payback, and the $1 version of the wagering game has the highest expected payback. It should be appreciated that any suitable denominations may be employed, such as $0.02, $0.10, $0.50, and $5.

In certain other embodiments, two or more of the wagering games that are simultaneously displayed are different wagering games. In one of these embodiments, at least two of the different displayed wagering games have the same average expected payback and the same volatility. In another one of these embodiments, at least two of the different displayed wagering games have the same average expected payback and different volatilities. In another one of these embodiments, at least two of the different displayed wagering games have different average expected paybacks and the same volatility. In another one of these embodiments, at least two of the different displayed wagering games have different average expected paybacks and different volatilities. In certain of these embodiments, at least two of the different displayed wagering games have the same bonus opportunities (such as bonus games or bonus payouts), while in other of these embodiments, at least two of the different displayed wagering games have different bonus opportunities. It should be appreciated that the different bonus opportunities may affect one or both of the average expected payback and the volatility of the displayed wagering game.

It should be appreciated that any suitable quantity of the wagering games that are simultaneously displayed may have the same or different average expected paybacks and/or volatilities.

In certain embodiments, the gaming system enables the player to change one or more of the displayed wagering games to a different wagering game or to a same wagering game having a different average expected payback, volatility, and/or bonus scheme. In various embodiments, the gaming system enables the player to change one or more of the displayed wagering games at any suitable time, such as: (a) at any time, (b) at a predetermined time or times, (c) after the displayed wagering game(s) to be changed have been played for a predetermined period, (d) after a predetermined quantity of credits have been wagered on the displayed wagering game (s) to be changed, (e) upon payment of a fee or additional wager, (f) upon the occurrence of a designated triggering event, or (g) any suitable combination thereof. It should be appreciated that, in certain embodiments, when the player changes a displayed wagering game to another wagering game, the credits included in the credit meter of the previously displayed wagering game are transferred to the credit meter of the newly displayed wagering game. It should be appreciated that if the credit to currency ratio of the newly displayed wagering game is different than that of the previously displayed wagering game, the credits are converted accordingly. For example, if 1 credit represents $1 in the new displayed wagering game, and 1 credit represented $0.50 in the previously displayed wagering game, the 100 credits displayed in the credit meter of the previously displayed wagering game are converted to 50 credits before being displayed in the credit meter of the newly displayed wagering game.

FIGS. 3A, 3B, 3C, and 3D illustrate screen shots of a gaming system, gaming device, and method of one example embodiment of the present disclosure, as generally described above. In this example the gaming system includes four simultaneously displayed spinning reel-type wagering games. For clarity and brevity: (1) the first spinning reel-type wagering game, which is the wagering game illustrated on the top left side of FIGS. 3A, 3B, 3C, and 3D and labeled "Game 1," is referred to herein as the first wagering game; the second spinning reel-type wagering game, which is the wagering game illustrated on the top right side of FIGS. 3A, 3B, 3C, and 3D and labeled "Game 2," is referred to herein as the second wagering game; the third spinning reel-type wagering game, which is the wagering game illustrated on the bottom left side of FIGS. 3A, 3B, 3C, and 3D and labeled "Game 3," is referred to herein as the third wagering game; and the fourth spinning reel-type wagering game, which is the wagering game illustrated on the bottom right side of FIGS. 3A, 3B, 3C, and 3D and labeled "Game 4," is referred to herein as the fourth wagering game. In this example, the first wagering game, the second wagering game, the third wagering game, and the fourth wagering game each include a plurality of different symbols displayable at a plurality of symbol display areas. In this example, in the first wagering game, the second wagering game, the third wagering game, and the fourth wagering game, 1 credit represents $1 of currency.

In this embodiment, a display device 120 adjacently displays symbol display areas 140*a*, 140*b*, 140*c*, 140*d*, 140*e*, 140*f*, 140*g*, 140*h*, and 140*i* of the first wagering game in a 3×3 grid or matrix. Display device 120 displays a plurality of paylines for the first wagering game, each of which is associated with a different plurality of the symbol display areas. Specifically, payline A 162*a* is associated with symbol display areas 140*a*, 140*b*, and 140*c*; payline B 162*b* is associated with symbol display areas 140*d*, 140*e*, and 140*f*; and payline C 162*c* is associated with symbol display areas 140*g*, 140*h*, and 140*i*. For clarity and brevity, payline A 162*a*, payline B 162*b*, and payline C 162*c* are sometimes referred to herein as paylines A, B, and C.

Display device 120 displays a paytable 132 for the first wagering game that includes a plurality of winning symbol combinations. Paytable 132 indicates the credit payout associated with each respective winning symbol combination. In this illustrated embodiment, paytable 132 indicates the credit payout associated with each respective winning symbol combination when the maximum wager for the first wagering game, which is 10 credits in this embodiment, is placed by a player for a play of the first wagering game. More specifically, winning symbol combination SEVEN-SEVEN-SEVEN is associated with an award of 1,000 credits; winning symbol combination BAR-BAR-BAR is associated with an award of 500 credits; winning symbol combination TRIPLE CHERRY-TRIPLE CHERRY-TRIPLE CHERRY is associated with an award of 250 credits; and winning symbol combination CHERRY-CHERRY-CHERRY is associated with an award of 100 credits.

Display device 120 displays a first award indicator or display 138, which indicates any award a player has won during a play of the first wagering game; a first wager indicator or display 136, which indicates any wager placed by the player for a play of the first wagering game; and a first a credit meter 134, which indicates the player's credit balance for the first wagering game.

Similarly, display device 120 adjacently displays symbol display areas 240*a*, 240*b*, 240*c*, 240*d*, 240*e*, 240*f*, 240*g*, 240*h*, and 240*i* of the second wagering game in a 3×3 grid or matrix. Display device 120 displays a plurality of paylines for the second wagering game, each of which is associated with a different plurality of the symbol display areas. Specifically, payline D 262*d* is associated with symbol display areas 240*a*, 240*b*, and 240*c*; payline C 262*c* is associated with symbol display areas 240*d*, 240*e*, and 240*f*; and payline D 262*d* is associated with symbol display areas 240*g*, 240*h*, and 240*i*. For clarity and brevity, payline D 262*d*, payline E 262*e*, and payline F 262*f* are sometimes referred to herein as paylines D, E, and F.

Display device 120 displays a paytable 232 for the second wagering game that includes a plurality of winning symbol combinations. Paytable 232 indicates the credit payout associated with each respective winning symbol combination. In this illustrated embodiment, paytable 232 indicates the credit payout associated with each respective winning symbol combination when the maximum wager for the second wagering game, which is 20 credits in this embodiment, is placed by a player for a play of the second wagering game. More specifically, winning symbol combination DOLLAR SIGN-DOLLAR SIGN-DOLLAR SIGN is associated with an award of 10,000 credits; winning symbol combination BELL-BELL-BELL is associated with an award of 1,000 credits; winning symbol combination DOUBLE BAR-DOUBLE BAR-DOUBLE BAR is associated with an award of 500 credits; and winning symbol combination ORANGE-ORANGE-ORANGE is associated with an award of 100 credits.

Display device 120 displays a second award indicator or display 238, which indicates any award a player has won during a play of the second wagering game; a second wager indicator or display 236, which indicates any wager placed by the player for a play of the second wagering game; and a second credit meter 234, which indicates the player's credit balance for the second wagering game.

Similarly, display device 120 adjacently displays symbol display areas 340*a*, 340*b*, 340*c*, 340*d*, 340*e*, 340*f*, 340*g*, 340*h*, and 340*i* of the third wagering game in a 3×3 grid or matrix. Display device 120 displays a plurality of paylines for the third wagering game, each of which is associated with a different plurality of the symbol display areas. Specifically, payline G 362*g* is associated with symbol display areas 340*a*, 340*e*, and 340*i*; and payline H 362*h* is associated with symbol display areas 340*g*, 340*e*, and 340*c*. For clarity and brevity, payline G 362*g* and payline H 362*h* are sometimes referred to herein as paylines G and H.

Display device 120 displays a paytable 332 for the third wagering game that includes a plurality of winning symbol combinations. Paytable 332 indicates the credit payout associated with each respective winning symbol combination. In this illustrated embodiment, paytable 332 indicates the credit payout associated with each respective winning symbol combination when the maximum wager for the third wagering game, which is 100 credits in this embodiment, is placed by a player for a play of the third wagering game. More specifically, winning symbol combination JACKPOT-JACKPOT-JACKPOT is associated with an award of 100,000 credits; winning symbol combination BANANA-BANANA-BANANA is associated with an award of 200 credits; and winning symbol combination CHERRY-CHERRY-CHERRY is associated with an award of 50 credits.

Display device 120 displays a third award indicator or display 338, which indicates any award a player has won during a play of the third wagering game; a third wager indicator or display 336, which indicates any wager placed by the player for a play of the third wagering game; and a third credit meter 334, which indicates the player's credit balance for the third wagering game.

Similarly, display device 120 adjacently displays symbol display areas 440*a*, 440*b*, 440*c*, 440*d*, 440*e*, 440*f*, 440*g*, 440*h*, and 440*i* of the fourth wagering game in a 3×3 grid or matrix. Display device 120 displays a plurality of paylines for the fourth wagering game, each of which is associated with a different plurality of the symbol display areas. Specifically, payline I 462*i* is associated with symbol display areas 440*a*, 440*d*, and 440*g*; payline J 462*j* is associated with symbol display areas 440*b*, 440*e*, and 440*h*; and payline K 462*k* is associated with symbol display areas 440*c*, 440*f*, and 440*i*. For clarity and brevity, payline I 462*i*, payline J 462*j*, and payline K 462*k* are sometimes referred to herein as paylines I, J, and K.

Display device 120 displays a paytable 432 for the fourth wagering game that includes a plurality of winning symbol combinations. Paytable 432 indicates the credit payout associated with each respective winning symbol combination. In this illustrated embodiment, paytable 432 indicates the credit payout associated with each respective winning symbol combination when the maximum wager for the fourth wagering game, which is 50 credits in this embodiment, is placed by a player for a play of the fourth wagering game. More specifically, winning symbol combination TRIPLE SEVEN-TRIPLE SEVEN-TRIPLE SEVEN is associated with an award of 5,000 credits; winning symbol combination DOLLAR SIGN-DOLLAR SIGN-DOLLAR SIGN is associated with an award of 1,000 credits; winning symbol combination TRIPLE CHERRY-TRIPLE CHERRY-TRIPLE CHERRY is associated with an award of 50 credits.

Display device 120 displays a fourth award indicator or display 438, which indicates any award a player has won during a play of the fourth wagering game; a fourth wager indicator or display 436, which indicates any wager placed by the player for a play of the fourth wagering game; and a fourth credit meter 434, which indicates the player's credit balance for the fourth wagering game.

Thus, in this example embodiment, the player is playing four wagering games simultaneously, each of which is a spinning reel game having a different paytable, a different minimum wager amount (explained below), a different volatility, and a different average expected payout.

It should be appreciated that the display device may display any suitable quantity of symbol display areas in any suitable configuration or arrangement for each of the wagering games. It also should be appreciated that the display device may display any suitable quantity of paylines for each of the wagering games. It should further be appreciated that each of the displayed paylines may be associated with any suitable quantity of the symbol display areas for each of the displayed wagering games. It should further be appreciated that each of the displayed paylines may be associated with any suitable combination of the symbol display areas for each of the displayed wagering games. While, in this embodiment, the displayed wagering games are displayed on a single display device, it should be appreciated that the displayed wagering games may be displayed on any suitable quantity and on any suitable type of display device.

It should be appreciated that the paytable may be modified to reflect lower credit payouts when a wager that is less than the maximum wager is placed by the player for one or more of the displayed wagering games. It should also be appreciated that any suitable paytable including any suitable quantity of winning symbol combinations may be used for each of the displayed wagering games. It should further be appreciated that any suitable combinations of the symbols may be used as winning symbol combinations for each of the displayed wagering games. It should be appreciated that the winning symbol combinations may be associated with any suitable credit payouts for each of the displayed wagering games. It should also be appreciated that any suitable quantity of paytables may be used for each of the displayed wagering games. It should further be appreciated that any suitable symbols may be used for each of the displayed wagering games. The symbols may include, for example, any suitable markings or indicia such as letters, numbers, or illustrations or pictures of objects.

Figure 3A:
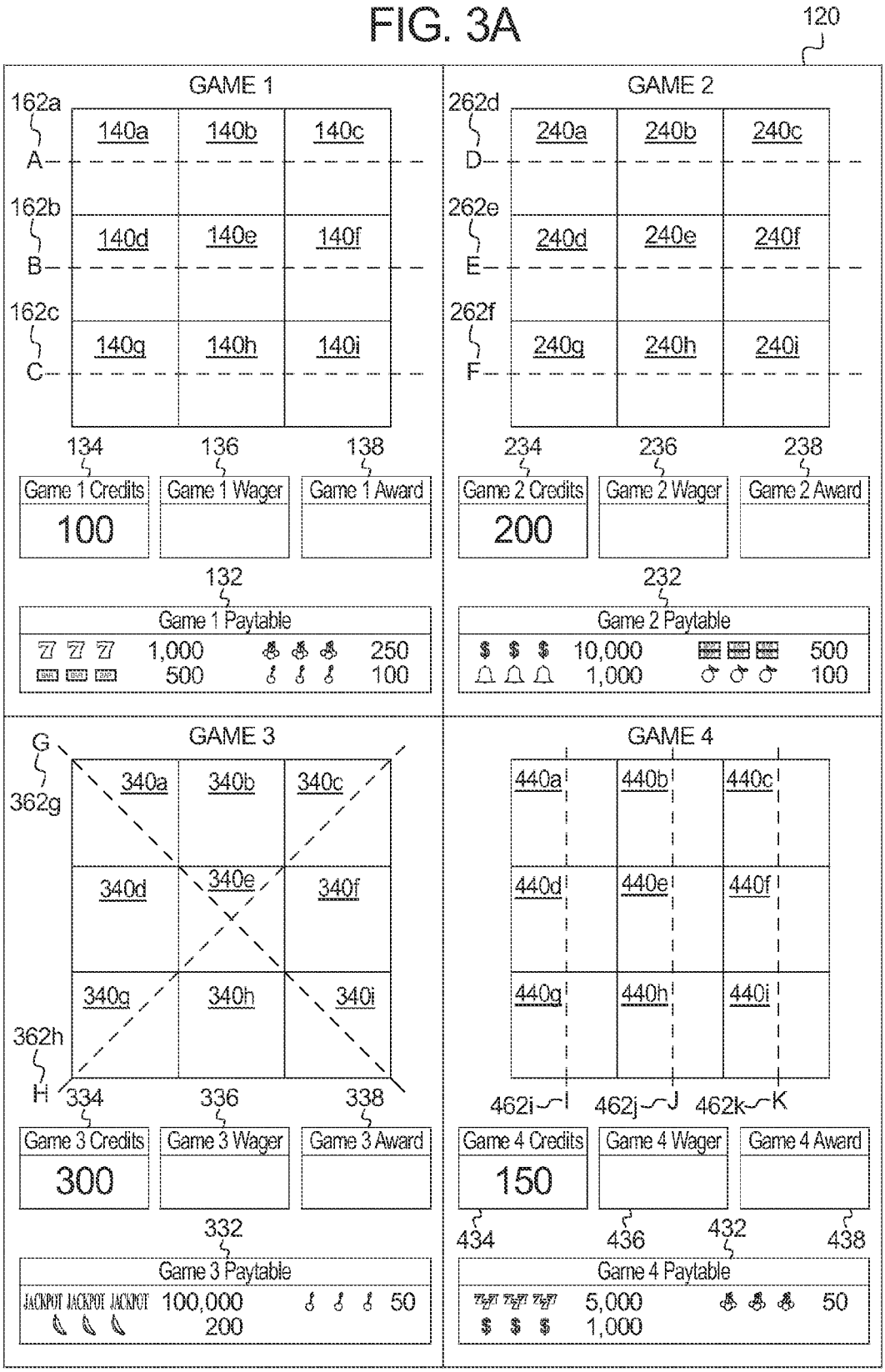
FIGS. 3A, 3B, 3C, and 3D are front views of a display device of an example gaming system or gaming device of one embodiment the present disclosure and illustrate a plurality of consecutive example plays of the gaming system or gaming device providing multiple simultaneously playable wagering games with individual credit balances.

As illustrated in FIG. 3A, a player deposits $750 of currency that, in this embodiment, represents 750 credits. In this example, the player allocates 100 of those credits to first credit meter 134 for use in the first wagering game, 200 of those credits to second credit meter 234 for use in the second wagering game, 300 of those credits to third credit meter 334 for use in the third wagering game, and 150 of those credits to fourth credit meter 434 for use in the fourth wagering game.

Figure 3B:
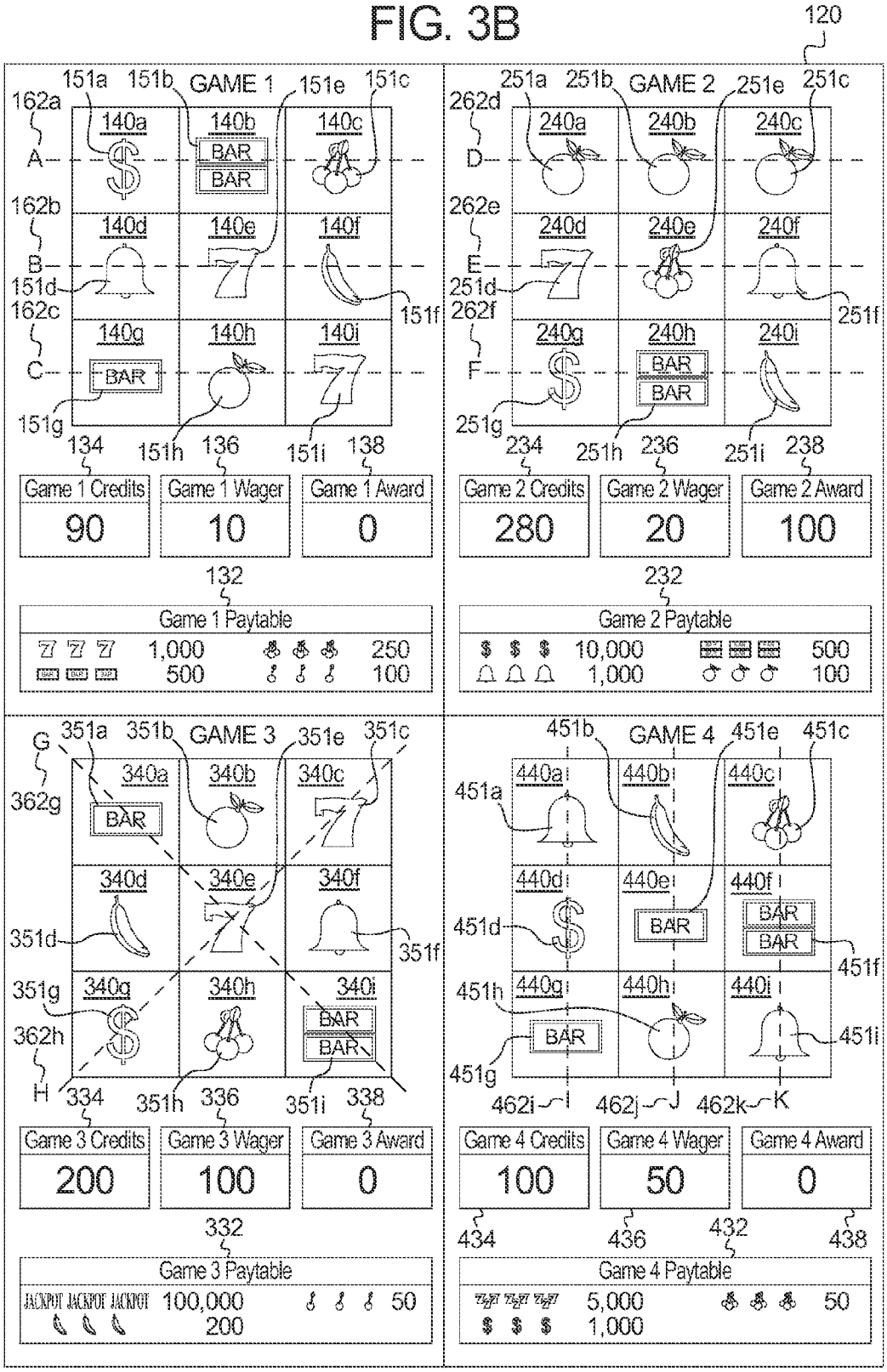

As illustrated in FIG. 3B, the player begins a play of the first wagering game by placing a wager on one or more of paylines A, B, and C. In this example, the player places the maximum wager of 10 credits, which activates each of paylines A, B, and C. The player's wager of 10 credits is indicated in first wager indicator 136. The gaming system randomly generates symbols 151*a*, 151*b*, 151*c*, 151*d*, 151*e*, 151*f*, 151*g*, 151*h*, and 151*i* at symbol display areas 140*a*, 140*b*, 140*c*, 140*d*, 140*e*, 140*f*, 140*g*, 140*h*, and 140*i*, respectively. None of the paylines are associated with a winning symbol combination in this example. An award of 0 credits is displayed in first award indicator 138. The player's credit balance for the first wagering game displayed in first credit meter 134 decreases to 90 credits, which reflects the player's initial credit balance of 100 credits minus the player's wager of 10 credits. Second credit meter 234, third credit meter 334, and fourth credit meter 434 are not affected by this play of the first wagering game.

The player also begins a play of the second wagering game by placing a wager on one or more of paylines D, E, and F. In this example, the player places the maximum wager of 20 credits, which activates each of paylines D, E, and F. The player's wager of 20 credits is indicated in second wager indicator 236. The gaming system randomly generates symbols 251*a*, 251*b*, 251*c*, 251*d*, 251*e*, 251*f*, 251*g*, 251*h*, and 251*i* at symbol display areas 240*a*, 240*b*, 240*c*, 240*d*, 240*e*, 240*f*, 240*g*, 240*h*, and 240*i*, respectively. Only payline D is associated with a winning symbol combination in this example. Specifically, symbol display areas 240*a*, 240*b*, and 240*c* along payline D each display ORANGE symbols 251*a*, 251*b*, and 251*c*, respectively. As indicated in paytable 232, the player wins an award of 100 credits for the displayed ORANGE-ORANGE-ORANGE winning symbol combination, and the award is displayed in second award indicator 238. The player's credit balance for the second wagering game displayed in second credit mater 234 increases to 280 credits, which reflects the player's initial credit balance of 200 credits minus the player's wager of 20 credits plus the player's award of 100 credits. First credit meter 134, third credit meter 334, and fourth credit meter 434 are not affected by this play of the second wagering game.

The player also begins a play of the third wagering game by placing a wager on one or more of paylines G and H. In this example, the player places the maximum wager of 100 credits, which activates each of paylines G and H. The player's wager of 100 credits is indicated in third wager indicator 336. The gaming system randomly generates symbols 351*a*, 351*b*, 351*c*, 351*d*, 351*e*, 351*f*, 351*g*, 351*h*, and 351*i* at symbol display areas 340*a*, 340*b*, 340*c*, 340*d*, 340*e*, 340*f*, 340*g*, 340*h*, and 340*i*, respectively. None of the paylines are associated with a winning symbol combination in this example. An award of 0 credits is displayed in third award indicator 338. The player's credit balance for the third wagering game displayed in third credit meter 334 decreases to 200 credits, which reflects the player's initial credit balance of 300 credits minus the player's wager of 100 credits. First credit meter 134, second credit meter 234, and fourth credit meter 434 are not affected by this play of the third wagering game.

The player also begins a play of the fourth wagering game by placing a wager on one or more of paylines I, J, and K. In this example, the player places the maximum wager of 50 credits, which activates each of paylines I, J, and K. The player's wager of 50 credits is indicated in fourth wager indicator 436. The gaming system randomly generates symbols 451*a*, 451*b*, 451*c*, 451*d*, 451*e*, 451*f*, 451*g*, 451*h*, and 451*i* at symbol display areas 440*a*, 440*b*, 440*c*, 440*d*, 440*e*, 440*f*, 440*g*, 440*h*, and 440*i*, respectively. None of the paylines are associated with a winning symbol combination in this example. An award of 0 credits is displayed in fourth award indicator 438. The player's credit balance for the fourth wagering game displayed in fourth credit meter 434 decreases to 100 credits, which reflects the player's initial credit balance of 150 credits minus the player's wager of 50 credits. First credit meter 134, second credit meter 234, and third credit meter 234 are not affected by this play of the fourth wagering game.

Figure 3C:
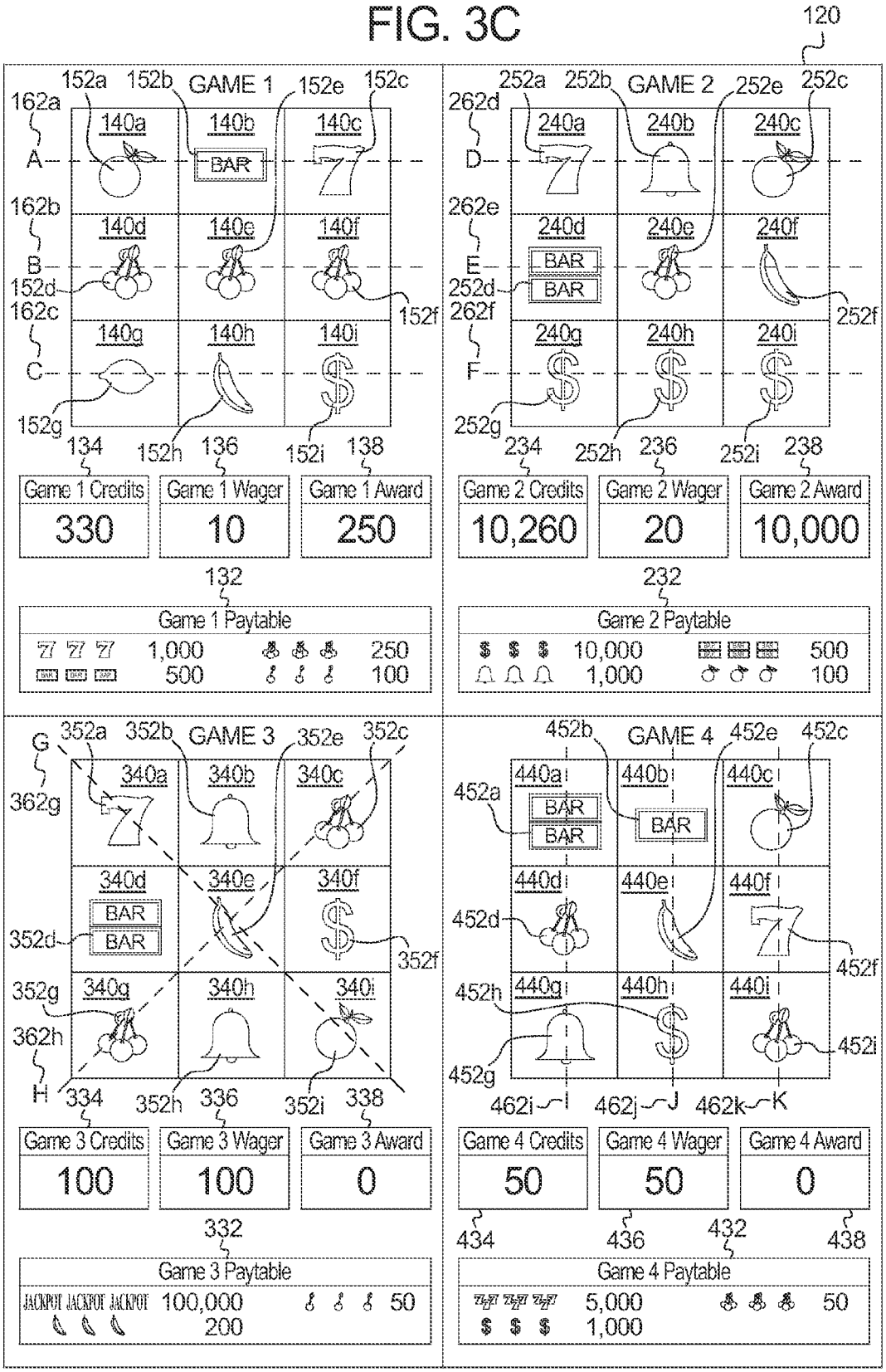

As illustrated in FIG. 3C, the player begins another play of the first wagering game by placing a wager on one or more of paylines A, B, and C. In this example, the player places the maximum wager of 10 credits, which activates each of paylines A, B, and C. The player's wager of 10 credits is indicated in first wager indicator 136. The gaming system randomly generates symbols 152*a*, 152*b*, 152*c*, 152*d*, 152*e*, 152*f*, 152*g*, 152*h*, and 152*i* at symbol display areas 140*a*, 140*b*, 140*c*, 140*d*, 140*e*, 140*f*, 140*g*, 140*h*, and 140*i*, respectively. Only payline B is associated with a winning symbol combination in this example. Specifically, symbol display areas 140*d*, 140*e*, and 140*f* along payline B each display TRIPLE CHERRY symbols 152*d*, 152*e*, and 152*f*, respectively. As indicated in paytable 132, the player wins an award of 250 credits for the displayed TRIPLE CHERRY-TRIPLE CHERRY-TRIPLE CHERRY winning symbol combination, and the award is displayed in first award indicator 138. The player's credit balance for the first wagering game displayed in first credit meter 134 increases to 330 credits, which reflects the player's initial credit balance of 90 credits minus the player's wager of 10 credits plus the player's award of 250 credits. Second credit meter 234, third credit meter 334, and fourth credit meter 434 are not affected by this play of the first wagering game.

The player also begins another play of the second wagering game by placing a wager on one or more of paylines D, E, and F. In this example, the player places the maximum wager of 20 credits, which activates each of paylines D, E, and F. The player's wager of 20 credits is indicated in second wager indicator 236. The gaming system randomly generates symbols 252*a*, 252*b*, 252*c*, 252*d*, 252*e*, 252*f*, 252*g*, 252*h*, and 252*i* at symbol display areas 240*a*, 240*b*, 240*c*, 240*d*, 240*e*, 240*f*, 240*g*, 240*h*, and 240*i*, respectively. Only payline F is associated with a winning symbol combination in this example. Specifically, symbol display areas 240*g*, 240*h*, and 240*i* along payline F each display DOLLAR SIGN symbols 252*g*, 252*h*, and 252*i*, respectively. As indicated in paytable 232, the player wins an award of 10,000 credits for the displayed DOLLAR SIGN-DOLLAR SIGN-DOLLAR SIGN winning symbol combination, and the award is displayed in second award indicator 238. The player's credit balance for the second wagering game displayed in second credit meter 234 increases to 10,260 credits, which reflects the player's initial credit balance of 180 credits minus the player's wager of 20 credits plus the player's award of 10,000 credits. First credit meter 134, third credit meter 334, and fourth credit meter 434 are not affected by this play of the second wagering game.

The player also begins another play of the third wagering game by placing a wager on one or more of paylines G and H. In this example, the player places the maximum wager of 100 credits, which activates each of paylines G and H. The player's wager of 100 credits is indicated in third wager indicator 336. The gaming system randomly generates symbols 352*a*, 352*b*, 352*c*, 352*d*, 352*e*, 352*f*, 352*g*, 352*h*, and 352*i* at symbol display areas 340*a*, 340*b*, 340*c*, 340*d*, 340*e*, 340*f*, 340*g*, 340*h*, and 340*i*, respectively. None of the paylines are associated with a winning symbol combination in this example. An award of 0 credits is displayed in third award indicator 338. The player's credit balance for the third wagering game displayed in third credit meter 334 decreases to 100 credits, which reflects the player's initial credit balance of 200 credits minus the player's wager of 100 credits. First credit meter 134, second credit meter 234, and fourth credit meter 434 are not affected by this play of the third wagering game.

The player also begins another play of the fourth wagering game by placing a wager on one or more of paylines I, J, and K. In this example, the player places the maximum wager of 50 credits, which activates each of paylines I, J, and K. The player's wager of 50 credits is indicated in fourth wager indicator 436. The gaming system randomly generates symbols 452*a*, 452*b*, 452*c*, 452*d*, 452*e*, 452*f*, 452*g*, 452*h*, and 452*i* at symbol display areas 440*a*, 440*b*, 440*c*, 440*d*, 440*e*, 440*f*, 440*g*, 440*h*, and 440*i*, respectively. None of the paylines are associated with a winning symbol combination in this example. An award of 0 credits is displayed in fourth award indicator 438. The player's credit balance for the fourth wagering game displayed in fourth credit meter 434 decreases to 50 credits, which reflects the player's initial credit balance of 100 credits minus the player's wager of 50 credits. First credit meter 134, second credit meter 234, and third credit meter 334 are not affected by this play of the fourth wagering game.

Figure 3D:
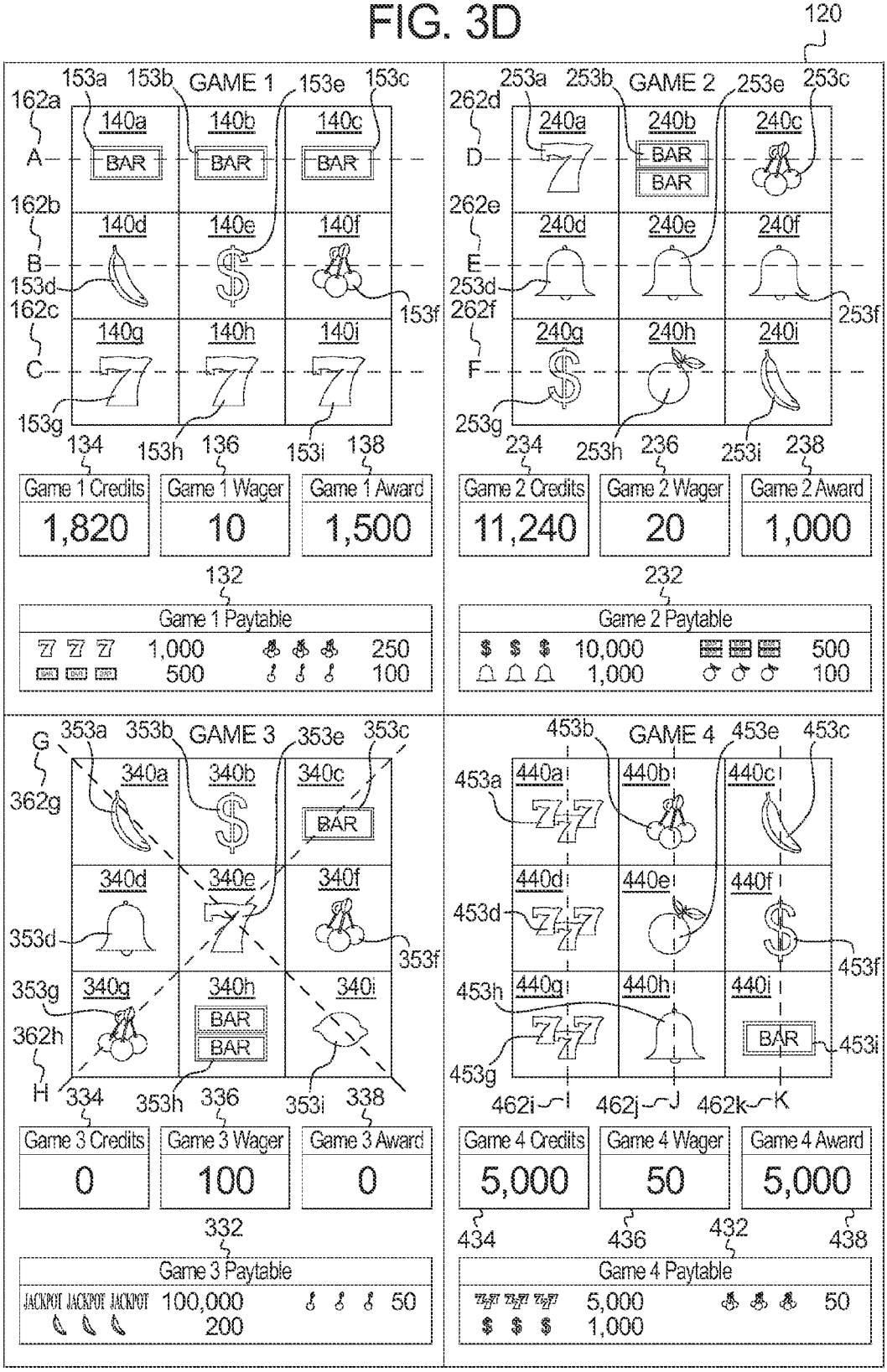

As illustrated in FIG. 3D, the player begins another play of the first wagering game by placing a wager on one or more of paylines A, B, and C. In this example, the player places the maximum wager of 10 credits, which activates each of paylines A, B, and C. The player's wager of 10 credits is indicated in first wager indicator 136. The gaming system randomly generates symbols 153*a*, 153*b*, 153*c*, 153*d*, 153*e*, 153*f*, 153*g*, 153*h*, and 153*i* at symbol display areas 140*a*, 140*b*, 140*c*, 140*d*, 140*e*, 140*f*, 140*g*, 140*h*, and 140*i*, respectively. Only paylines A and C are associated with a winning symbol combination in this example. Specifically, symbol display areas 140*a*, 140*b*, and 140*c* along payline A each display BAR symbols 153*a*, 153*b*, and 153*c*, respectively. As indicated in paytable 132, the player wins an award of 500 credits for the displayed BAR-BAR-BAR winning symbol combination. Symbol display areas 140*g*, 140*h*, and 140*i* along payline C each display SEVEN symbols 153*g*, 153*h*, and 153*i*, respectively. As indicated in paytable 132, the player wins an award of 1,000 credits for the displayed SEVEN-SEVEN-SEVEN winning symbol combination. The awards are summed and the total award of 1,500 credits is displayed in first award indicator 138. The player's credit balance for the first wagering game displayed in first credit meter 134 increases to 1,820 credits, which reflects the player's initial credit balance of 330 credits minus the player's wager of 10 credits plus the player's award of 1,500 credits. Second credit meter 234, third credit meter 334, and fourth credit meter 434 are not affected by this play of the first wagering game.

The player also begins another play of the second wagering game by placing a wager on one or more of paylines D, E, and F. In this example, the player places the maximum wager of 20 credits, which activates each of paylines D, E, and F. The player's wager of 20 credits is indicated in second wager indicator 236. The gaming system randomly generates symbols 253*a*, 253*b*, 253*c*, 253*d*, 253*e*, 253*f*, 253*g*, 253*h*, and 253*i* at symbol display areas 240*a*, 240*b*, 240*c*, 240*d*, 240*e*, 240*f*, 240*g*, 240*h*, and 240*i*, respectively. Only payline E is associated with a winning symbol combination in this example. Specifically, symbol display areas 240*d*, 240*e*, and 240*f* along payline E each display BELL symbols 253*d*, 253*e*, and 253*f*, respectively. As indicated in paytable 232, the player wins an award of 1,000 credits for the displayed BELL-BELL-BELL winning symbol combination, and the award is displayed in second award indicator 238. The player's credit balance for the second wagering game displayed in second credit meter 234 increases to 11,240 credits, which reflects the player's initial credit balance of 10,260 credits minus the player's wager of 20 credits plus the player's award of 1,000 credits. First credit meter 134, third credit meter 334, and fourth credit meter 434 are not affected by this play of the second wagering game.

The player also begins another play of the third wagering game by placing a wager on one or more of paylines G and H. In this example, the player places the maximum wager of 100 credits, which activates each of paylines G and H. The player's wager of 100 credits is indicated in third wager indicator 336. The gaming system randomly generates symbols 353*a*, 353*b*, 353*c*, 353*d*, 353*e*, 353*f*, 353*g*, 353*h*, and 353*i* at symbol display areas 340*a*, 340*b*, 340*c*, 340*d*, 340*e*, 340*f*, 340*g*, 340*h*, and 340*i*, respectively. None of the paylines are associated with a winning symbol combination in this example. An award of 0 credits is displayed in third award indicator 338. The player's credit balance for the third wagering game displayed in third credit meter 334 decreases to 0 credits, which reflects the player's initial credit balance of 100 credits minus the player's wager of 100 credits. First credit meter 134, second credit meter 234, and fourth credit meter 434 are not affected by this play of the third wagering game.

The player also begins another play of the fourth wagering game by placing a wager on one or more of paylines I, J, and K. In this example, the player places the maximum wager of 50 credits, which activates each of paylines I, J, and K. The player's wager of 50 credits is indicated in fourth wager indicator 436. The gaming system randomly generates symbols 453*a*, 453*b*, 453*c*, 453*d*, 453*e*, 453*f*, 453*g*, 453*h*, and 453*i* at symbol display areas 440*a*, 440*b*, 440*c*, 440*d*, 440*e*, 440*f*, 440*g*, 440*h*, and 440*i*, respectively. Only payline I is associated with a winning symbol combination in this example. Specifically, symbol display areas 440*a*, 440*d*, and 440*g* along payline I each display TRIPLE SEVEN symbols 453*a*, 453*d*, and 453*g*, respectively. As indicated in paytable 432, the player wins an award of 5,000 credits for the displayed TRIPLE SEVEN-TRIPLE SEVEN-TRIPLE SEVEN winning symbol combination, and the award is displayed in fourth award indicator 438. The player's credit balance for the fourth wagering game displayed in fourth credit meter 434 increases to 5,000 credits, which reflects the player's initial credit balance of 50 credits minus the player's wager of 50 credits plus the player's award of 5,000 credits. First credit meter 134, second credit meter 234, and third credit meter 334 are not affected by this play of the fourth wagering game.

It should, therefore, be appreciated from this example that the separate displayed credit meters of each of the different displayed wagering games enable the player to quickly and easily determine the relative success of one of the displayed wagering games in relation to each of the other displayed wagering games. For example, the player is easily able to determine that Game 2 is "hot" (three wins in a row with awards totaling 11,100 credits) and that Game 3 is "cold" (three losses in a row). Using this information, the player may modify the displayed wagering games or the player's method of play accordingly, such as by replacing Game 3 with a different wagering game or by modifying the player's betting strategy to bet less on Game 3 and more on Game 2.

Figure 4:
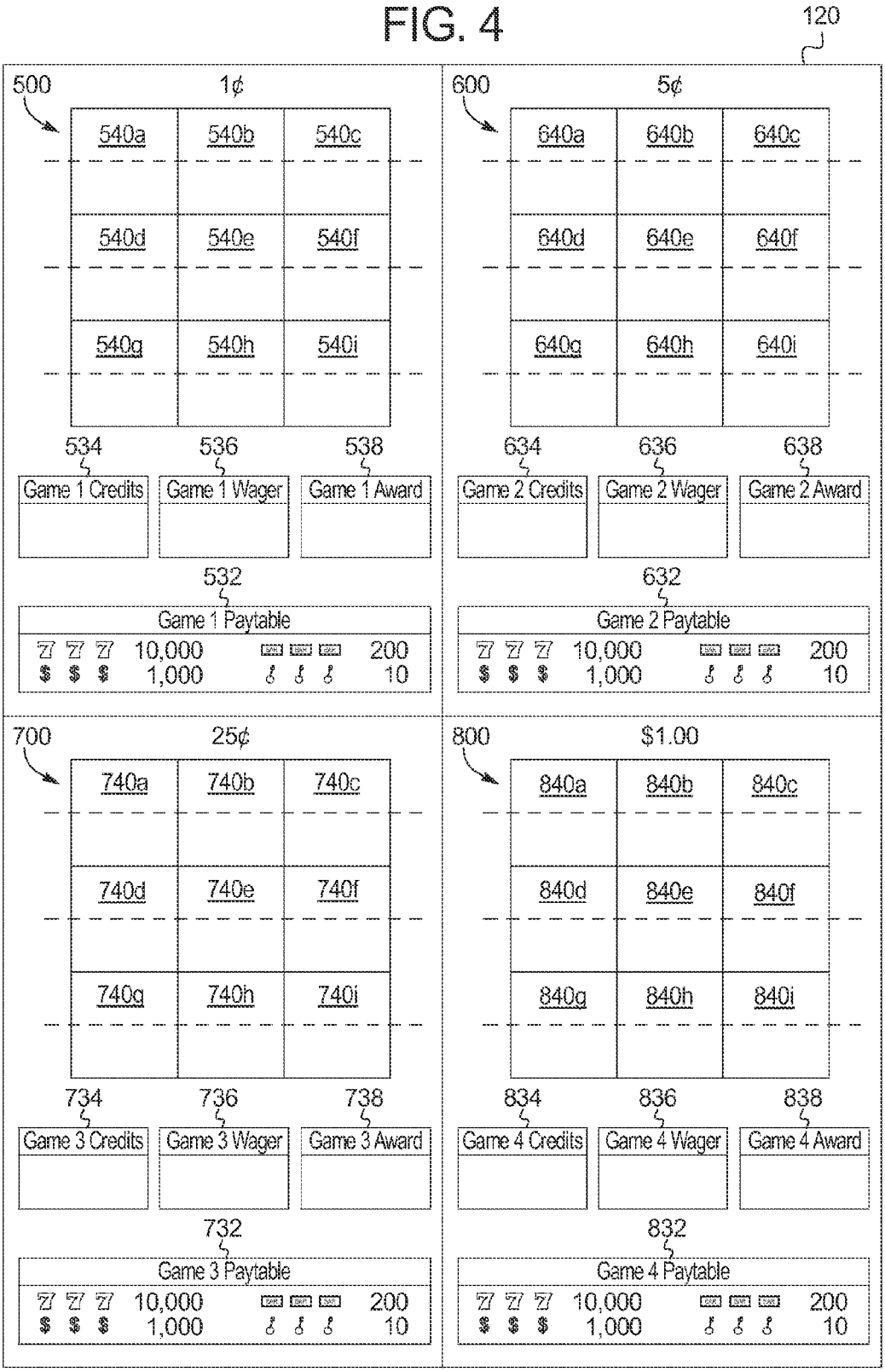
FIG. 4 is a front view of a display device of an example gaming system or gaming device of one embodiment of the present disclosure simultaneously displaying four versions of the same wagering game, each version having a different denomination.

FIG. 4 illustrates an example embodiment of the display device of the gaming system or gaming device of the present disclosure simultaneously displaying four versions of the same spinning reel-type wagering game—first version 500, second version 600, third version 700, and fourth version 800—each having its own separate displayed credit meter. In this example, each of first version 500, second version 600, third version 700, and fourth version 800 is considered different versions of the same wagering game because they each include the same plurality of symbols, the same quantity and arrangement of symbol display areas, the same paylines, and the same paytable. The differences among the displayed versions of the wagering game are the denominations and the average expected paybacks. Specifically, first version 500 is a $0.01 version of the wagering game (in which 1 credit represents $0.01), second version 600 is a $0.05 version of the wagering game (in which 1 credit represents $0.05), third version 700 is a $0.25 version of the wagering game (in which 1 credit represents $0.25), and fourth version 800 is a $1.00 version of the wagering game (in which 1 credit represents $1.00). In this example embodiment, the higher the denomination, the higher the average expected payback. Continuing with the above example, first version 500 has the lowest average expected payback, second version 600 has the second lowest average expected payback, third version 700 has the second highest average expected payback, and fourth version 800 has the highest expected payback. Thus, it should be appreciated from this example that the gaming system providing multiple simultaneously playable wagering games with individual credit balances of the present disclosure enables a player to simultaneously play different versions of the same wagering game, thereby enabling the player to quickly and easily visually compare how the different versions of the wagering game perform in relation to one another by looking at the displayed credit meters. For example, it enables a player to determine which of the versions of that wagering game the player likes the most or that the player believes to be the most profitable. The gaming system, therefore, increases player enjoyment and excitement by providing the player an opportunity to play a variety of versions of a wagering game simultaneously while enabling the player to quickly and easily keep track of the wagering and awards associated with each of the simultaneously displayed versions of the wagering game.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming device comprising:

at least one processor;

at least one display device;

at least one input device; and at least one memory device storing a plurality of instructions which, when executed by the at least one processor, cause the at least one processor to operate with the at least one display device and the at least one input device to:

(a) simultaneously display a plurality of wagering games, each of the displayed wagering games having a separate credit meter;

(b) simultaneously display the credit meters of the displayed wagering games;

(c) enable a player to transfer credits from the displayed credit meter of one of the displayed wagering games to the displayed credit meter of another one of the displayed wagering games;

(d) for each of the displayed wagering games, display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) after receiving a deposit, allocate said deposit to one or more of the displayed credit meters by at least one of: evenly allocating said deposit among each of the displayed credit meters, allocating said deposit based on the total number of credits in each of the displayed credit meters, and allocating said deposit such that the displayed credit meters are balanced.

2. The gaming device of claim 1, wherein the plurality of instructions, when executed by the at least one processor, cause the at least one processor to report a combination of each of the displayed credit meters to a central controller as a single credit meter.

3. The gaming device of claim 1, wherein the plurality of instructions, when executed by the at least one processor, cause the at least one processor to operate with the at least one display device to display a holding meter, the displayed holding meter being separate from the displayed credit meters.

4. The gaming device of claim 3, wherein the plurality of instructions, when executed by the at least one processor, cause the at least one processor to operate with the at least one input device to enable the player to transfer credits from the displayed holding meter to one or more of the displayed credit meters.

5. The gaming device of claim 3, wherein the plurality of instructions, when executed by the at least one processor, cause the at least one processor to operate with the at least one input device to enable the player to transfer credits from one or more of the displayed credit meters to the displayed holding meter.

6. The gaming device of claim 1, wherein at least two of the displayed wagering games are different wagering games.

7. The gaming device of claim 1, wherein at least two of the displayed wagering games are a same wagering game.

8. A method of operating a gaming system, said method comprising:

(a) causing at least one processor to execute a plurality of instructions stored in at least one memory device to operate with at least one display device to simultaneously display a plurality of wagering games, each of the displayed wagering games having a separate credit meter;

(b) causing the at least one processor to execute the plurality of instructions to operate with the at least one display device to simultaneously display the credit meters of the displayed wagering games;

(c) causing the at least one processor to execute the plurality of instructions to operate with at least one input device to enable a player to transfer credits from the displayed credit meter of one of the displayed wagering games to the displayed credit meter of another one of the displayed wagering games;

(d) for each of the displayed wagering games, causing the at least one processor to execute the plurality of instructions to operate with the at least one display device to display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) after receiving a deposit, causing the at least one processor to execute the plurality of instructions to allocate said deposit to one or more of the displayed credit meters by at least one of: evenly allocating said deposit among each of the displayed credit meters, allocating said deposit based on the total number of credits in each of the displayed credit meters, and allocating said deposit such that the displayed credit meters are balanced.

9. The method of claim 8, which includes causing the at least one processor to execute the plurality of instructions to report a combination of each of the displayed credit meters to a central controller as a single credit meter.

10. The method of claim 8, which includes causing the at least one processor execute the plurality of instructions to operate with the at least one display device to display a holding meter, the displayed holding meter being separate from the displayed credit meters.

11. The method of claim 10, which includes causing the at least one processor to execute the plurality of instructions to operate with the at least one input device to enable the player to transfer credits from the displayed holding meter to one or more of the displayed credit meters.

12. The method of claim 10, which includes causing the at least one processor to execute the plurality of instructions to operate with the at least one input device to enable the player to transfer credits from one or more of the displayed credit meters to the displayed holding meter.

13. The method of claim 8, wherein at least two of the displayed wagering games are different wagering games.

14. The method of claim 8, wherein at least two of the displayed wagering games are a same wagering game.

15. The method of claim 8, which is provided through a data network.

16. The method of claim 15, wherein the data network is an internet.

17. A non-transitory computer readable medium including a plurality of instructions which, when executed by at least one processor, cause the at least one processor to:

(a) cause a display device to simultaneously display a plurality of wagering games, each of the displayed wagering games having a separate credit meter;

(b) cause the display device to simultaneously display the credit meters of the displayed wagering games;

(c) enable a player to transfer credits from the displayed credit meter of one of the displayed wagering games to the displayed credit meter of another one of the displayed wagering games;

(d) for each of the displayed wagering games, cause the display device to display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) after receiving a deposit, allocate said deposit to one or more of the displayed credit meters by at least one of: allocating said deposit to one of the displayed credit meters, evenly allocating said deposit among each of the displayed credit meters, allocating said deposit based on the total number of credits in each of the displayed credit meters, and allocating said deposit such that the displayed credit meters are balanced.

18. The non-transitory computer readable medium of claim 17, wherein the plurality of instructions, when executed by the at least one processor, cause the at least one processor to report a combination of each of the displayed credit meters to a central controller as a single credit meter.

19. The non-transitory computer readable medium of claim 17, wherein the plurality of instructions, when executed by the at least one processor, cause the at least one processor to cause the at least one display device to display a holding meter, the displayed holding meter being separate from the displayed credit meters.

20. The non-transitory computer readable medium of claim 19, wherein the plurality of instructions, when executed by the at least one processor, cause the at least one processor to enable the player to transfer credits from the displayed holding meter to one or more of the displayed credit meters.

21. The non-transitory computer readable medium of claim 19, wherein the plurality of instructions, when executed by the at least one processor, cause the at least one processor to enable the player to transfer credits from one or more of the displayed credit meters to the displayed holding meter.

22. The non-transitory computer readable medium of claim 17, wherein at least two of the displayed wagering games are different wagering games.

23. The non-transitory computer readable medium of claim 17, wherein at least two of the displayed wagering games are a same wagering game.

24. A gaming device comprising:

at least one processor;

at least one display device;

at least one input device; and at least one memory device storing a plurality of instructions which, when executed by the at least one processor, cause the at least one processor to operate with the at least one display device and the at least one input device to:

(a) simultaneously display a plurality of wagering games, each of the displayed wagering games having a separate credit meter;

(b) simultaneously display the credit meters of the displayed wagering games;

(c) enable a player to transfer credits from the displayed credit meter of one of the displayed wagering games to the displayed credit meter of another one of the displayed wagering games;

(d) for each of the displayed wagering games, display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) report a combination of each of the displayed credit meters to a central Controller as a single credit meter.

25. The gaming device of claim 24, wherein the plurality of instructions, when executed by the at least one processor, cause the at least one processor to operate with the at least one input device to, after receiving a deposit, enable the player to allocate said deposit to one or more of the displayed credit meters.

26. The gaming device of claim 24, wherein the plurality of instructions, when executed by the at least one processor, cause the at least one processor to, after receiving a deposit, allocate said deposit to one or more of the displayed credit meters.

27. The gaming device of claim 26, wherein the plurality of instructions, when executed by the at least one processor, cause the at least one processor to allocate said deposit to one or more of the displayed credit meters by at least one of: allocating said deposit to one of the displayed credit meters, evenly allocating said deposit among each of the displayed credit meters, allocating said deposit based on the total number of credits in each of the displayed credit meters, and allocating said deposit such that the displayed credit meters are balanced.

28. The gaming device of claim 24, wherein the plurality of instructions, when executed by the at least one processor, cause the at least one processor to operate with the at least one display device to display a holding meter, the displayed holding meter being separate from the displayed credit meters.

29. The gaming device of claim 28, wherein the plurality of instructions, when executed by the at least one processor, cause the at least one processor to operate with the at least one display device to, after receiving a deposit, allocate said deposit to the displayed holding meter and display said deposit in the displayed holding meter.

30. The gaming device of claim 28, wherein the plurality of instructions, when executed by the at least one processor, cause the at least one processor to operate with the at least one input device to enable the player to transfer credits from the displayed holding meter to one or more of the displayed credit meters.

31. The gaming device of claim 28, wherein the plurality of instructions, when executed by the at least one processor, cause the at least one processor to operate with the at least one input device to enable the player to transfer credits from one or more of the displayed credit meters to the displayed holding meter.

32. The gaming device of claim 24, wherein at least two of the displayed wagering games are different wagering games.

33. The gaming device of claim 24, wherein at least two of the displayed wagering games are a same wagering game.

34. A method of operating a gaming system, said method comprising:

(a) causing at least one processor to execute a plurality of instructions stored in at least one memory device to operate with at least one display device to simultaneously display a plurality of wagering games, each of the displayed wagering games having a separate credit meter;

(b) causing the at least one processor to execute the plurality of instructions to operate with the at least one display device to simultaneously display the credit meters of the displayed wagering games;

(c) causing the at least one processor to execute the plurality of instructions to operate with at least one input device to enable a player to transfer credits from the displayed credit meter of one of the displayed wagering games to the displayed credit meter of another one of the displayed wagering games;

(d) for each of the displayed wagering games, causing the at least one processor to execute the plurality of instructions to operate with the at least one display device to display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) causing the at least one processor to execute the plurality of instructions to report a combination of each of the displayed credit meters to a central controller as a single credit meter.

35. The method of claim 34, which includes causing the at least one processor to execute the plurality of instructions to operate with the at least one input device to, after receiving a deposit, enable the player to allocate said deposit to one or more of the displayed credit meters.

36. The method of claim 34, which includes causing the at least one processor to execute the plurality of instructions to, after receiving a deposit, allocate said deposit to one or more of the displayed credit meters.

37. The method of claim 36, wherein causing the at least one processor to execute the plurality of instructions to allocate said deposit to one or more of the displayed credit meters includes at least one of: causing the at least one processor to execute the plurality of instructions to allocate said deposit to one of the displayed credit meters, causing the at least one processor to execute the plurality of instructions to evenly allocate said deposit among each of the displayed credit meters, causing the at least one processor to execute the plurality of instructions to allocate said deposit based on the total number of credits in each of the displayed credit meters, and causing the at least one processor to execute the plurality of instructions to allocate said deposit such that the displayed credit meters are balanced.

38. The method of claim 34, which includes causing the at least one processor execute the plurality of instructions to operate with the at least one display device to display a holding meter, the displayed holding meter being separate from the displayed credit meters.

39. The method of claim 38, which includes causing the at least one processor to execute the plurality of instructions to operate with the at least one display device to, after receiving a deposit, allocate said deposit to the displayed holding meter and display said deposit in the displayed holding meter.

40. The method of claim 38, which includes causing the at least one processor to execute the plurality of instructions to operate with the at least one input device to enable the player to transfer credits from the displayed holding meter to one or more of the displayed credit meters.

41. The method of claim 38, which includes causing the at least one processor to execute the plurality of instructions to operate with the at least one input device to enable the player to transfer credits from one or more of the displayed credit meters to the displayed holding meter.

42. The method of claim 34, wherein at least two of the displayed wagering games are different wagering games.

43. The method of claim 34, wherein at least two of the displayed wagering games are a same wagering game.

44. The method of claim 34, which is provided through a data network.

45. The method of claim 44, wherein the data network is an internet.

46. A non-transitory computer readable medium including a plurality of instructions which, when executed by at least one processor, cause the at least one processor to:

(a) cause a display device to simultaneously display a plurality of wagering games, each of the displayed wagering games having a separate credit meter;

(b) cause the display device to simultaneously display the credit meters of the displayed wagering games;

(c) enable a player to transfer credits from the displayed credit meter of one of the displayed wagering games to the displayed credit meter of another one of the displayed wagering games;

(d) for each of the displayed wagering games, cause the display device to display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) report a combination of each of the displayed credit meters to a central controller as a single credit meter.

47. The non-transitory computer readable medium of claim 46, wherein the plurality of instructions, when executed by the at least one processor, cause the at least one processor to, after receiving a deposit, enable the player to allocate said deposit to one or more of the displayed credit meters.

48. The non-transitory computer readable medium of claim 46, wherein the plurality of instructions, when executed by the at least one processor, cause the at least one processor to, after receiving a deposit, allocate said deposit to one or more of the displayed credit meters.

49. The non-transitory computer readable medium of claim 48, wherein the plurality of instructions, when executed by the at least one processor, cause the at least one processor to allocate said deposit to one or more of the displayed credit meters by at least one of: allocating said deposit to one of the displayed credit meters, evenly allocating said deposit among each of the displayed credit meters, allocating said deposit based on the total number of credits in each of the displayed credit meters, and allocating said deposit such that the displayed credit meters are balanced.

50. The non-transitory computer readable medium of claim 46, wherein the plurality of instructions, when executed by the at least one processor, cause the at least one processor to cause the at least one display device to display a holding meter, the displayed holding meter being separate from the displayed credit meters.

51. The non-transitory computer readable medium of claim 50, wherein the plurality of instructions, when executed by the at least one processor, cause the at least one processor to, after receiving a deposit, allocate said deposit to the displayed holding meter and cause the at least one display device to display said deposit in the displayed holding meter.

52. The non-transitory computer readable medium of claim 50, wherein the plurality of instructions, when executed by the at least one processor, cause the at least one processor to enable the player to transfer credits from the displayed holding meter to one or more of the displayed credit meters.

53. The non-transitory computer readable medium of claim 50, wherein the plurality of instructions, when executed by the at least one processor, cause the at least one processor to enable the player to transfer credits from one or more of the displayed credit meters to the displayed holding meter.

54. The non-transitory computer readable medium of claim 46, wherein at least two of the displayed wagering games are different wagering games.

55. The non-transitory computer readable medium of claim 46, wherein at least two of the displayed wagering games are a same wagering game.

56. A gaming device comprising:

at least one processor;

at least one display device;

at least one input device; and at least one memory device storing a plurality of instructions which, when executed by the at least one processor, cause the at least one processor to operate with the at least one display device and the at least one input device to:

(a) simultaneously display a plurality of wagering games, each of the displayed wagering games having a separate credit meter;

(b) simultaneously display the credit meters of the displayed wagering games;

(c) enable a player to transfer credits from the displayed credit meter of one of the displayed wagering games to the displayed credit meter of another one of the displayed wagering games;

(d) for each of the displayed wagering games, display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) display a holding meter, the displayed holding meter being separate from the displayed credit meters.

57. The gaming device of claim 56, wherein the plurality of instructions, when executed by the at least one processor, cause the at least one processor to operate with the at least one input device to, after receiving a deposit, enable the player to allocate said deposit to one or more of the displayed credit meters.

58. The gaming device of claim 56, wherein the plurality of instructions, when executed by the at least one processor, cause the at least one processor to, after receiving a deposit, allocate said deposit to one or more of the displayed credit meters.

59. The gaming device of claim 58, wherein the plurality of instructions, when executed by the at least one processor, cause the at least one processor to allocate said deposit to one or more of the displayed credit meters by at least one of: allocating said deposit to one of the displayed credit meters, evenly allocating said deposit among each of the displayed credit meters, allocating said deposit based on the total number of credits in each of the displayed credit meters, and allocating said deposit such that the displayed credit meters are balanced.

60. The gaming device of claim 56, wherein the plurality of instructions, when executed by the at least one processor, cause the at least one processor to report a combination of each of the displayed credit meters to a central controller as a single credit meter.

61. The gaming device of claim 56, wherein the plurality of instructions, when executed by the at least one processor, cause the at least one processor to operate with the at least one display device to, after receiving a deposit, allocate said deposit to the displayed holding meter and display said deposit in the displayed holding meter.

62. The gaming device of claim 56, wherein the plurality of instructions, when executed by the at least one processor, cause the at least one processor to operate with the at least one input device to enable the player to transfer credits from the displayed holding meter to one or more of the displayed credit meters.

63. The gaming device of claim 56, wherein the plurality of instructions, when executed by the at least one processor, cause the at least one processor to operate with the at least one input device to enable the player to transfer credits from one or more of the displayed credit meters to the displayed holding meter.

64. The gaming device of claim 56, wherein at least two of the displayed wagering games are different wagering games.

65. The gaming device of claim 56, wherein at least two of the displayed wagering games are a same wagering game.

66. A method of operating a gaming system, said method comprising:

(a) causing at least one processor to execute a plurality of instructions stored in at least one memory device to operate with at least one display device to simultaneously display a plurality of wagering games, each of the displayed wagering games having a separate credit meter;

(b) causing the at least one processor to execute the plurality of instructions to operate with the at least one display device to simultaneously display the credit meters of the displayed wagering games;

(c) causing the at least one processor to execute the plurality of instructions to operate with at least one input device to enable a player to transfer credits from the displayed credit meter of one of the displayed wagering games to the displayed credit meter of another one of the displayed wagering games;

(d) for each of the displayed wagering games, causing the at least one processor to execute the plurality of instructions to operate with the at least one display device to display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter (e) causing the at least one processor execute the plurality of instructions to operate with the at least one display device to display a holding meter, the displayed holding meter being separate from the displayed credit meters.

67. The method of claim 66, which includes causing the at least one processor to execute the plurality of instructions to operate with the at least one input device to, after receiving a deposit, enable the player to allocate said deposit to one or more of the displayed credit meters.

68. The method of claim 66, which includes causing the at least one processor to execute the plurality of instructions to, after receiving a deposit, allocate said deposit to one or more of the displayed credit meters.

69. The method of claim 68, wherein causing the at least one processor to execute the plurality of instructions to allocate said deposit to one or more of the displayed credit meters includes at least one of: causing the at least one processor to execute the plurality of instructions to allocate said deposit to one of the displayed credit meters, causing the at least one processor to execute the plurality of instructions to evenly allocate said deposit among each of the displayed credit meters, causing the at least one processor to execute the plurality of instructions to allocate said deposit based on the total number of credits in each of the displayed credit meters, and causing the at least one processor to execute the plurality of instructions to allocate said deposit such that the displayed credit meters are balanced.

70. The method of claim 66, which includes causing the at least one processor to execute the plurality of instructions to report a combination of each of the displayed credit meters to a central controller as a single credit meter.

71. The method of claim 66, which includes causing the at least one processor to execute the plurality of instructions to operate with the at least one display device to, after receiving a deposit, allocate said deposit to the displayed holding meter and display said deposit in the displayed holding meter.

72. The method of claim 66, which includes causing the at least one processor to execute the plurality of instructions to operate with the at least one input device to enable the player to transfer credits from the displayed holding meter to one or more of the displayed credit meters.

73. The method of claim 66, which includes causing the at least one processor to execute the plurality of instructions to operate with the at least one input device to enable the player to transfer credits from one or more of the displayed credit meters to the displayed holding meter.

74. The method of claim 66, wherein at least two of the displayed wagering games are different wagering games.

75. The method of claim 66, wherein at least two of the displayed wagering games are a same wagering game.

76. The method of claim 66, which is provided through a data network.

77. The method of claim 76, wherein the data network is an internet.

78. A non-transitory computer readable medium including a plurality of instructions which, when executed by at least one processor, cause the at least one processor to:

(a) cause a display device to simultaneously display a plurality of wagering games, each of the displayed wagering games having a separate credit meter;

(b) cause the display device to simultaneously display the credit meters of the displayed wagering games;

(c) enable a player to transfer credits from the displayed credit meter of one of the displayed wagering games to the displayed credit meter of another one of the displayed wagering games;

(d) for each of the displayed wagering games, cause the display device to display a total number of credits in the displayed credit meter of said displayed wagering game, the total number of credits including:

(i) a first sum of: (1) any credits deposited into said displayed credit meter, (2) any credits won during play of said displayed wagering game, and (3) any credits transferred into said displayed credit meter; less (ii) a second sum of: (1) any credits wagered on any plays of said displayed wagering game, (2) any credits transferred from said displayed credit meter, and (3) any credits cashed out of said displayed credit meter; and (e) cause the at least one display device to display a holding meter, the displayed holding meter being separate from the displayed credit meters.

79. The non-transitory computer readable medium of claim 78, wherein the plurality of instructions, when executed by the at least one processor, cause the at least one processor to, after receiving a deposit, enable the player to allocate said deposit to one or more of the displayed credit meters.

80. The non-transitory computer readable medium of claim 78, wherein the plurality of instructions, when executed by the at least one processor, cause the at least one processor to, after receiving a deposit, allocate said deposit to one or more of the displayed credit meters.

81. The non-transitory computer readable medium of claim 80, wherein the plurality of instructions, when executed by the at least one processor, cause the at least one processor to allocate said deposit to one or more of the displayed credit meters by at least one of: allocating said deposit to one of the displayed credit meters, evenly allocating said deposit among each of the displayed credit meters, allocating said deposit based on the total number of credits in each of the displayed credit meters, and allocating said deposit such that the displayed credit meters are balanced.

82. The non-transitory computer readable medium of claim 78, wherein the plurality of instructions, when executed by the at least one processor, cause the at least one processor to report a combination of each of the displayed credit meters to a central controller as a single credit meter.

83. The non-transitory computer readable medium of claim 78, wherein the plurality of instructions, when executed by the at least one processor, cause the at least one processor to, after receiving a deposit, allocate said deposit to the displayed holding meter and cause the at least one display device to display said deposit in the displayed holding meter.

84. The non-transitory computer readable medium of claim 78, wherein the plurality of instructions, when executed by the at least one processor, cause the at least one processor to enable the player to transfer credits from the displayed holding meter to one or more of the displayed credit meters.

85. The non-transitory computer readable medium of claim 78, wherein the plurality of instructions, when executed by the at least one processor, cause the at least one processor to enable the player to transfer credits from one or more of the displayed credit meters to the displayed holding meter.

86. The non-transitory computer readable medium of claim 78, wherein at least two of the displayed wagering games are different wagering games.

87. The non-transitory computer readable medium of claim 78, wherein at least two of the displayed wagering games are a same wagering game.

* * * * *

UNITED STATES PATENT AND TRADEMARK OFFICE

CERTIFICATE OF CORRECTION

PATENT NO. : 8,512,120 B2
APPLICATION NO. : 13/238781
DATED : September 20, 2011
INVENTOR(S) : Dwayne R. Nelson et al.

It is certified that error appears in the above-identified patent and that said Letters Patent is hereby corrected as shown below:

IN THE CLAIMS

In Claim 10, Column 35, Line 66, between "processor" and "execute" insert --to--.
In Claim 19, Column 36, Line 63, delete "at least one".
In Claim 38, Column 39, Line 29, between "processor" and "execute" insert --to--.
In Claim 50, Column 40, Line 40, delete "at least one".
In Claim 51, Column 40, Line 47, delete "at least one".
In Claim 66, Column 42, Line 47, between "processor" and "execute" insert --to--.
In Claim 78, Column 44, Line 4, delete "at least one".
In Claim 83, Column 44, Line 37, delete "at least one".

Signed and Sealed this
Twelfth Day of August, 2014

Michelle K. Lee

Michelle K. Lee
*Deputy Director of the United States Patent and Trademark Office*